US006355333B1

(12) United States Patent
Waggoner et al.

(10) Patent No.: US 6,355,333 B1
(45) **Date of Patent: *Mar. 12, 2002**

(54) CONSTRUCTION MEMBRANE

(75) Inventors: James Ross Waggoner; Mieczyclaw Stachnik, both of Midlothian; Theresa A. Weston, Richmond; Michael Allen Bryner, Midlothian, all of VA (US)

(73) Assignee: E. I. du Pont de Nemours and Company, Wilmington, DE (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/329,008

(22) Filed: Jun. 9, 1999

Related U.S. Application Data

(63) Continuation-in-part of application No. 09/207,212, filed on Dec. 8, 1998, now abandoned.
(60) Provisional application No. 60/067,996, filed on Dec. 9, 1997.

(51) Int. Cl.[7] ..... E04D 1/34
(52) U.S. Cl. ..... 428/174; 428/182; 428/219; 428/913; 52/169.14; 52/408; 52/630
(58) Field of Search ..... 52/169.14, 408, 52/630; 428/174, 182, 137, 913, 219

(56) References Cited

U.S. PATENT DOCUMENTS

| | | | | |
|---|---|---|---|---|
| 3,169,899 | A | 2/1965 | Steuber | 161/72 |
| 3,532,589 | A | 10/1970 | David | 161/150 |
| 4,090,385 | A | 5/1978 | Packard | 72/191 |
| 4,091,137 | A | 5/1978 | Miller | 428/198 |
| 4,223,059 | A | 9/1980 | Schwarz | 428/198 |
| 4,696,138 | A | 9/1987 | Bullock | 52/407 |

(List continued on next page.)

FOREIGN PATENT DOCUMENTS

| | | | |
|---|---|---|---|
| JP | 60-124419 | 8/1985 | E04B/1/76 |
| JP | 1-83805 | 6/1989 | E04B/1/70 |
| JP | 09001712 | 7/1997 | |
| JP | 11-62124 A | 3/1999 | E04D/12/00 |
| WO | WO 97/40224 | 10/1997 | D04H/3/16 |

OTHER PUBLICATIONS

Anonymously, Tyvek® Air Infiltration Barrier In Housing Construction, *Research Disclosure*, 556, Oct. 1979.
Tyvek® Housewrap, Case History, Dupont Tyvek®, Jun. 1990.
Wrap–Up, Dupont Tyvek®, vol. 1, No. 3, Dec. 1992.
Tyvek® Housewrap, Tyvek® Housewrap Solves Moisture Problems, Generates Customer Satisfaction in Stucco Homes, Dupont Tyvek®, H–61280, Feb. 1995.
Tech Hotline, Sto Mechanically Attached Drainage EIF System, STO Technical Services Department, TH996FSD, Sep. 1996.
Vertical Siding Strips Not Needed Because The Sheet Has Draining Grooves, Rib Sheet, 1988.
Hal–Tex "Stucco–Vent" 2–Ply Corrugated Building Paper Brochure, HAL Industries Inc., May 1997.

*Primary Examiner*—Blaine Copenheaver
*Assistant Examiner*—Alicia Chevalier

(57) ABSTRACT

A construction membrane that resists liquid and air penetration, is moisture vapor permeable, and has integral drainage channels is provided. An exterior wall construction incorporating such barrier sheet material is also provided. The wall construction may be faced with stucco, siding, brick or stone. A method for bonding and texturing the construction membrane is also provided.

13 Claims, 12 Drawing Sheets

U.S. PATENT DOCUMENTS

| | | | | | |
|---|---|---|---|---|---|
| 4,717,329 | A | | 1/1988 | Packard et al. | 425/328 |
| 4,894,196 | A | | 1/1990 | Walton et al. | 264/282 |
| 4,929,303 | A | | 5/1990 | Sheth | 156/209 |
| 4,943,185 | A | | 7/1990 | McGuckin et al. | 405/45 |
| 4,999,222 | A | * | 3/1991 | Jones et al. | 427/250 |
| 5,057,351 | A | * | 10/1991 | Jones et al. | 428/138 |
| 5,085,817 | A | * | 2/1992 | Jones et al. | 264/175 |
| 5,122,412 | A | * | 6/1992 | Jones et al. | 428/296 |
| 5,129,813 | A | | 7/1992 | Shepherd | 425/504 |
| 5,224,318 | A | * | 7/1993 | Kemerer | 52/521 |
| 5,302,099 | A | | 4/1994 | Serafini | 425/84 |
| 5,308,691 | A | * | 5/1994 | Lim et al. | 428/286 |
| 5,518,799 | A | | 5/1996 | Finestone et al. | 428/137 |
| 5,554,246 | A | | 9/1996 | Anwyll, Jr. | 156/253 |
| 5,593,768 | A | * | 1/1997 | Gessner | 428/286 |
| 5,826,390 | A | | 10/1998 | Sacks | 52/408 |
| 5,863,639 | A | * | 1/1999 | Franke et al. | 428/198 |
| 5,972,147 | A | | 10/1999 | Janis | 156/181 |
| 6,122,877 | A | * | 9/2000 | Hendrickson et al. | 52/520 |

* cited by examiner

CONSTRUCTION MEMBRANE

This application is a continuation-in-part of U.S. patent application Ser. No. 09/207,212, filed on Dec. 8, 1998, now abandoned which claims benefit of priority from Provisional Application No. 60/067,996 filed on Dec. 9, 1997.

FIELD OF THE INVENTION

This invention relates to air and water infiltration barrier sheet materials useful in the construction of housing and other structures. More particularly, the invention relates to a sheet material that is permeable to moisture vapor, but is substantially impermeable to liquids and air, and that provides channels for drainage of liquids when the sheet material is incorporated in a wall construction. The invention further relates to wall constructions made with such sheet material, including stucco-faced wall constructions, brick-faced and stone-faced wall constructions, and wood and vinyl siding wall constructions.

BACKGROUND OF THE INVENTION

A number of different air and/or water infiltration barrier materials are currently used in the construction of the external walls of structures. Barrier materials are available in the form of sheets that can be incorporated into the walls of a structure under the outer facade of the wall. Such barrier sheet materials are designed to prevent the intrusion of incidental water, which passes through the primary facade, into the frame of the structure where water could cause mold, mildew, rotting, or other structural damage. Some barrier sheet materials also prevent the infiltration of air (and the moisture carried with such air) into the structure so as to make the structure more comfortable and energy efficient. While barrier sheet materials should be substantially impermeable to liquid water and air, they should not trap moisture vapor within walls where the vapor could condense as water and cause mildew or structural damage. It is also important that a barrier sheet material not trap water that enters walls through exterior cracks, around windows, doors and other joints, or around water taps or electric fixtures.

Barrier sheet material has been used in most kinds of exterior wall constructions including wall constructions with stucco, brick, stone, and siding facades. Barrier sheet materials used under siding include asphalt impregnated kraft papers and felts, perforated polymer films, spunbonded polymer sheets, and microporous film laminates. Barrier sheet materials that have been used under stucco include asphalt impregnated kraft papers and felts, spunbonded polymer sheets, and perforated polymer films.

One barrier sheet material that has been advantageously used in both siding and stucco wall constructions is TYVEK®) spunbonded polyethylene sheet sold by E.I. duPont de Nemours & Company of Wilmington, Del. ("DuPont"). Tyvek® is a registered trademark of DuPont. TYVEK® spunbonded polyethylene sheet is made from a consolidated web of flash-spun polyethylene plexifilamentary film-fibrils made as disclosed in U.S. Pat. No. 3,169,899 to Steuber and bonded as disclosed in U.S. Pat. No. 3,532,589 to David or PCT Publication No. WO 97/40224 (all assigned to DuPont). As used herein, the term "plexifilamentary" means a three-dimensional integral network of a multitude of thin, ribbon-like, film-fibril elements of random length and with a mean film thickness of less than about 10 microns and a median fibril width of less than about 25 microns. In plexifilamentary structures, the film-fibril elements are generally coextensively aligned with the longitudinal axis of the plexifilamentary structure and they intermittently unite and separate at irregular intervals in various places throughout the length, width and thickness of the plexifilamentary structure to form a continuous three-dimensional network. A TYVEK® spunbonded polyethylene sheet designed for use as a barrier sheet material for construction applications has been sold by DuPont under the names TYVEK® Housewrap and TYVEK® HOMEWRAP®.

In structures made using frame construction, the frame of the structure is generally made from metal or wood studs covered with an exterior sheathing such as plywood, oriented strand board ("OSB"), composite particle board, gypsum board, or foam board. This exterior sheathing is covered with a barrier sheet material, which is then covered with an exterior facade material such as wood siding, hardboard or vinyl siding, brick or stone, or stucco. In some cases, the barrier sheet material is applied directly to the frame studs without an exterior sheathing ("open frame construction").

Siding is generally applied directly over the barrier sheet material by pounding nails through the siding, the barrier sheet material, and into the sheathing or the studs. The nail holes through the barrier sheet material can provide an avenue through which air, moisture vapor, or water can get through the barrier sheet material. Water intrusion behind barrier sheet material applied under siding can also occur around windows, doors, and electrical fixtures that have been poorly flashed or caulked, or at other joints and penetrations. If water finds its way behind the barrier sheet material, whether through nail holes or through poorly sealed joints, this bulk water can build up behind the barrier sheet where the water is likely to damage the structure's sheathing, insulation or frame.

Where a barrier sheet material is used in frame construction faced with brick or stone, water can find its way into walls through cracks and pores in the pointing, the brick, or the stone. Water incursion through the brick or stone facade is most likely to occur around windows, doors, and electrical fixtures, and along the roof line, especially if joints have been improperly flashed or caulked. Water that penetrates the exterior facade can then penetrate the barrier sheet material if it is difficult for the water to drain down the exterior side of the barrier sheet. Water that finds its way behind barrier sheet material applied under brick or stone may damage the structure's sheathing, insulation or frame.

In frame construction faced with traditional three coat Portland cement plaster, known as stucco, the barrier sheet material is incorporated into the stucco-faced wall construction 10, as shown in FIG. 1. In the stucco-faced wall construction 10, the studs 12 of the structure are covered with either line wires 14 (open frame construction) or with one of the sheathing materials (not shown) discussed above. The wires 14 or the sheathing are covered with a barrier sheet 16. In stucco-faced wall constructions, the barrier sheet materials that have traditionally been used are asphalt impregnated rag felts and water resistant papers such as asphalt saturated kraft paper. Another barrier sheet that has more recently been used in stucco-faced frame construction is TYVEK® spunbonded polyethylene sheet. The barrier sheet material can be stapled, nailed or glued to the studs or sheathing material. A metal lath 18 , such as a self-furred hexagonal woven wire lath ("chicken wire"), is applied over the barrier sheet 16 and attached to the studs 12 and/or the sheathing with staples or furring nails (not shown). A scratch coat 22 of stucco is applied over the wire lath 18 so that the stucco passes through the lath and contacts the barrier sheet. After the scratch coat has had an opportunity to dry, an intermediate brown coat 24 of stucco is applied over the scratch coat 22. Once the brown coat has had an opportunity to dry, a finish coat 26 of stucco is applied over the brown coat 24. Finish coat 26 may be pigmented or the finish coat may be painted.

Cracking of stucco frequently occurs while the stucco is drying and curing, or during subsequent thermal expansion and contraction of the sheathing, wood studs, or stucco. Water can pass through cracks in the stucco, through improperly sealed joints, or even through the porous stucco itself. Water that finds its way between the stucco and the barrier sheet, and water absorbed into an absorbent barrier sheet material (such as kraft paper), can generate additional breakdown of the stucco. Water passing through an absorbent barrier material can wet wooden studs so as to cause crack inducing expansion and contraction of the wall. Water absorbed into the barrier material and water present on the front or back sides of the barrier material may also generate rot in the barrier material, generate mildew and mold problems, and generate cracks in the stucco during freeze/thaw cycles. Water and moisture in the wall may also damage a structure's sheathing, insulation, or frame.

Water and moisture can also be a problem in synthetic stucco-faced wall constructions made using hybrid systems or Exterior Insulation and Finish Systems ("EIFS"). In a hybrid system and in some EIFS systems, a barrier sheet is applied either directly over the studs of a structure or over sheathing applied over the studs. In hybrid systems and in some EIFS systems that use a barrier sheet, an insulating foam board is applied over the barrier sheet and one or more coats of stucco are applied over the foam board. The foam may be screwed, nailed or otherwise fastened over the barrier sheet. In EIFS systems that do not use a barrier sheet, the foam board is glued or nailed directly to the exterior sheathing. The stucco coating is sometimes applied to the foam board prior to installation on a structure. Moisture intrusion behind the foam board has been a problem with EIFS systems, especially where no barrier sheet is used or where paper or felt are used as the barrier sheet material. Moisture trapped behind the foam can cause rot, mold and mildew problems in the wall.

Attempts have been made to facilitate the removal of water and water vapor from walls into which a barrier sheet is incorporated by building a cavity or channels next to the barrier sheet to provide an avenue through which water and water vapor can get out of the wall. For example, EIFS constructions have been made in which thin strips or a porous mat are inserted between the barrier sheet and the foam board in order to create channels through which water can escape the wall. In another EIFS construction, channels have been cut into the surface of the foam board that faces the barrier sheet to provide an avenue for the escape of water. The creation of cavities or channels next to the barrier sheet generally requires an expenditure of labor and or materials that make wall constructions with such channels unduly expensive to produce.

Accordingly, in exterior wall constructions where a barrier sheet material is used, there is a need for a barrier sheet material that facilitates the removal of bulk water and water vapor from the wall. Such a barrier sheet material should be substantially impermeable to air and liquid water, but it should not be impermeable to water vapor. The barrier sheet material should not readily absorb water or water vapor that can cause damage in a wall and the barrier sheet should not be made of a material that might rot. For stucco applications, it is also preferred that the barrier sheet material not hinder the stucco curing process.

SUMMARY OF THE INVENTION

The invention provides a construction membrane comprising a nonwoven, spunbonded, barrier sheet material consisting essentially of synthetic fibers, the sheet material having a basis weight of less than 600 g/m$^2$, a hydrostatic head of greater than 12 cm, a Gurley Hill porosity of greater than 10 seconds, a moisture vapor transmission rate, measured by the LYSSY method, of at least 25 g/m$^2$/day. The barrier sheet material has a first side textured with multiple protrusions spaced over the first side and defining channels oriented in at least one general direction for providing a path by which a liquid against the first side of the sheet can drain. Preferably, the barrier sheet material is a unitary sheet. According to one embodiment of the invention, the barrier sheet material has a second side opposite the first side, the second side being textured with multiple protrusions spaced over the second side and defining channels oriented in at least one general direction for providing a path by which a liquid against the second side of the sheet can drain. The multiple protrusions are preferably formed by an embossing process.

Preferably, the protrusions have a height in the range of 0.25 mm to 1.0 mm. It is further preferred that the protrusions form a random polyhedral pattern on the first surface of the barrier sheet material. Alternatively, the sheet material may be corrugated such that the first and second sides of the sheet material are defined by a plurality of alternating ridges and grooves. The amplitude of such corrugations fluctuate along the length of the corrugations between areas of high corrugation amplitude where the amplitude of the corrugations is between 0.4 and 1.0 mm and areas of low corrugation amplitude where the amplitude of the corrugations is less than 60% of the amplitude of the corrugations in the areas of high corrugation amplitude. The areas of low corrugation amplitude preferably define channels by which a liquid against a side of the sheet can drain in a direction that is generally perpendicular to the ridges and grooves of the corrugations.

The barrier sheet material of the invention more preferably has a basis weight of less than 300 g/m$^2$, a hydrostatic head of greater than 50 cm, a Gurley Hill porosity of greater than 60 seconds, and a moisture vapor transmission rate, measured by the LYSSY method, of at least 100 g/m$^2$/day. Most preferably, the barrier sheet material has a basis weight of less than 125 g/m$^2$, a hydrostatic head of greater than 150 cm, a Gurley Hill porosity of greater than 120 seconds, and a moisture vapor transmission rate, measured by the LYSSY method, of at least 250 g/m$^2$/day.

The synthetic fibers of the barrier sheet preferably consist essentially of polyolefin polymer fibers. It is further preferred that the polyolefin polymer fibers consist essentially of polyethylene plexifilamentary film fibrils.

The present invention is also directed to a wall structure comprising a support frame, a barrier sheet material over the support frame, and an exterior protective layer over the barrier sheet, wherein the barrier sheet material is a nonwoven, spunbonded sheet consisting essentially of synthetic fibers, the sheet material having a basis weight of less than 600 g/m$^2$, a hydrostatic head of greater than 12 cm, a Gurley Hill porosity of greater than 10 seconds, a moisture vapor transmission rate, measured by the LYSSY method, of at least 25 g/m$^2$/day. The barrier sheet material has a first side that is textured with multiple protrusions spaced over the first side to define channels oriented in at least one general direction for providing a path by which a liquid against the first side of the sheet can drain. The exterior protective layer is selected from the group of stucco, hybrid stucco, brick, stone, wood siding, metal siding, and synthetic siding materials. Preferably the barrier sheet material is a unitary sheet wherein the synthetic fibers consist essentially of polyolefin polymer fibers. More preferably, the polyolefin polymer fibers consist essentially of polyethylene plexifilamentary film fibrils.

BRIEF DESCRIPTION OF THE DRAWINGS

The accompanying drawings, which are incorporated in and constitute a part of this specification, illustrate the presently preferred embodiments of the invention and, together with the description, serve to explain the principles of the invention.

DETAILED DESCRIPTION OF THE INVENTION

Figure 1:
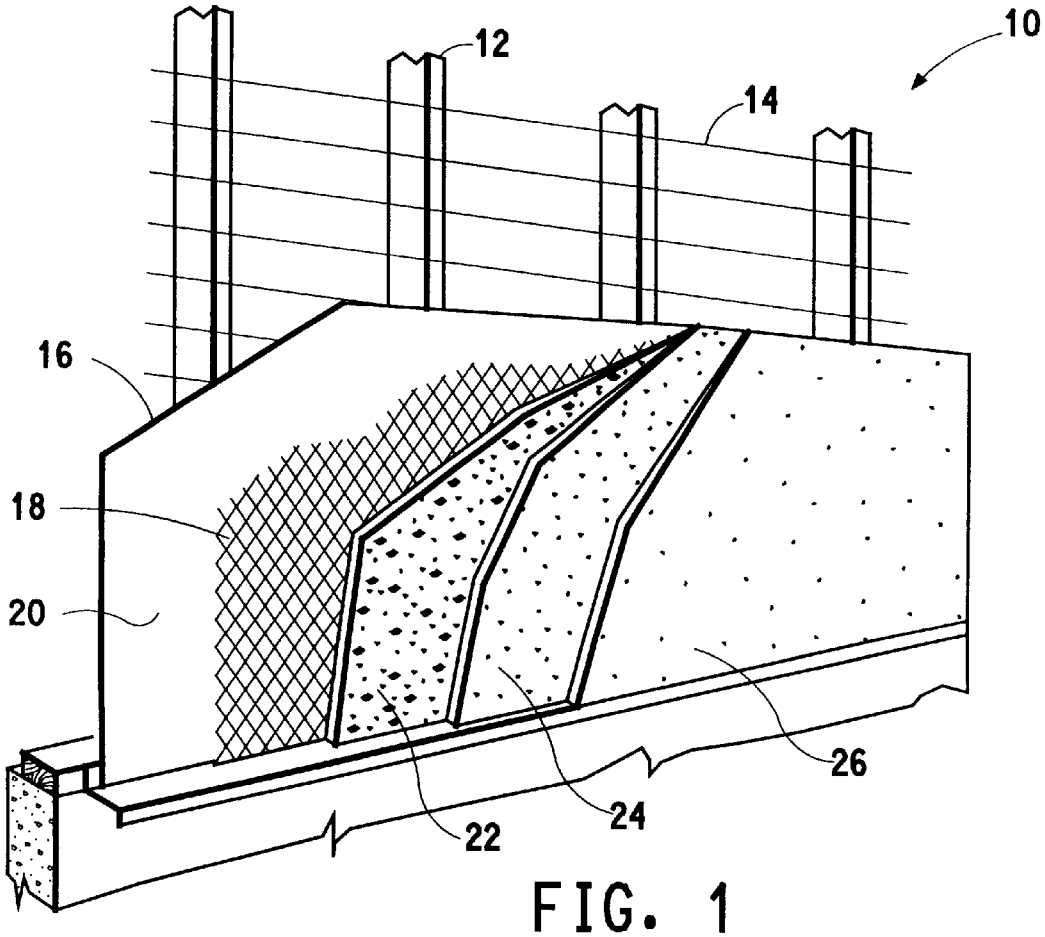
FIG. 1 (PRIOR ART)
FIG. 1 is a cut away view of an open frame stucco-faced wall construction according to the prior art.

Reference will now be made in detail to the presently preferred embodiments of the invention, examples of which are illustrated below.

According to the present invention, a sheet material is provided that acts as a barrier to the infiltration of most air and liquid water, but does not act as a barrier to the passage of moisture vapor. The sheet material includes integral channel means for providing a passage through which water can flow out of a wall into which the sheet material is incorporated as a barrier sheet. Preferably, the channel means are elongated grooves formed on at least one surface of the sheet. Such elongated grooves may be formed by embossing, creping, corrugating, or otherwise texturing a flat sheet.

The barrier sheet material of the invention is preferably flexible and preferably has a basis weight of less than 340 $g/m^2$ (10 $oz/yd^2$), and more preferably less than about 136 $g/m^2$ (4 $oz/yd^2$). The barrier sheet material of the invention should act as a barrier to the passage of water (i.e., has a hydrostatic head of greater than 12 cm, and more preferably greater than about 75 cm, and most preferably greater than about 180 cm.) The barrier sheet material of the invention also preferably acts as an air infiltration barrier (i.e., has a Gurley Hill Porosity of greater than 10 seconds (air permeability decreases with increasing Gurley Hill Porosity values), and more preferably greater than about 100 seconds, and most preferably greater than 250 seconds. The barrier sheet material of the invention should not block the transmission of moisture vapor (i.e., has a moisture vapor transmission rate, measured by the LYSSY method, of at least 25 $g/m^2$/day, and more preferably at least 200 $g/m^2$/day, and most preferably at least 800 $g/m^2$/day.

According to the present invention, the barrier sheet material includes integral channel means oriented in at least one general direction for providing a path of escape for water trapped in a wall into which the barrier sheet is incorporated. As used herein, "integral channel means" is defined to mean channels that are incorporated into the barrier sheet material and do not require a separate structure or layer apart from the barrier sheet material. Preferably, the barrier sheet material is a unitary sheet. As used herein, "unitary sheet" means a sheet with a substantially homogeneous composition that is free of laminations or other support structures.

The channel means may comprise grooves formed on at least one side of the sheet material. Such grooves are preferably oriented generally in either the machine direction or the cross direction of the sheet material in order to facilitate the application of the barrier sheet to a wall construction in a manner that the grooves are oriented in a generally vertical direction whereby water in the grooves of the barrier sheet will be drained down through the grooves by gravitational forces. As used herein, the machine direction is the long direction within the plane of the sheet, i.e., the direction in which the sheet is produced. The cross direction is the direction within the plane of the sheet that is perpendicular to the machine direction. More preferably, the grooves are oriented in the cross direction of the sheet material such that a roll of the material can be used to horizontally wrap the length of a single story wall section with the grooves oriented in a generally downwardly direction. In other situations where structures are wrapped vertically, it will be more desirable that the grooves run in the sheet's machine direction.

The grooves of the barrier sheet are preferably between 0.2 and 1 mm deep and between 1.0 and 10 mm wide. In the embodiment of the invention shown in FIG. 2, the grooves are substantially straight and parallel with each other. However, it is anticipated that the grooves could be arranged in other generally vertical patterns such as the diamond pattern on the sheet 41 (shown in FIG. 3) or a vertical wave pattern. The grooves can be made by known methods for texturing a bonded sheet, as for example by creping, microstretching, embossing, or corrugating processes. It is preferred that the channels or grooves be arranged such that the space between grooves is no more than ten times the width of the grooves. In the embodiment of the invention shown in FIG. 2, the grooves are about 6.4 mm wide such that there are 4 to 5 grooves per 2.5 cm.

According to another embodiment of the invention, the integral channel means may comprise a pattern of geometric protrusions in the barrier sheet. When such a sheet is incorporated into a wall, the areas of the sheet between the protrusions form the channel means. The pattern created by the protrusions preferably produces drainage channels in both the machine direction and the cross direction of the sheet material. This arrangement of protrusions is beneficial because water on the surface of the sheet will have substantially vertical channels through which to drain by gravitational forces, regardless of the direction in which the sheet material is installed on a structure. The protrusions can be generated by known methods for embossing a bonded sheet, as for example using steel to rubber embossing rolls, or more preferably with matched steel to paper embossing rolls, or most preferably with matched steel to steel embossing rolls (herein referred to as "matched metal embossing").

Figure 16:
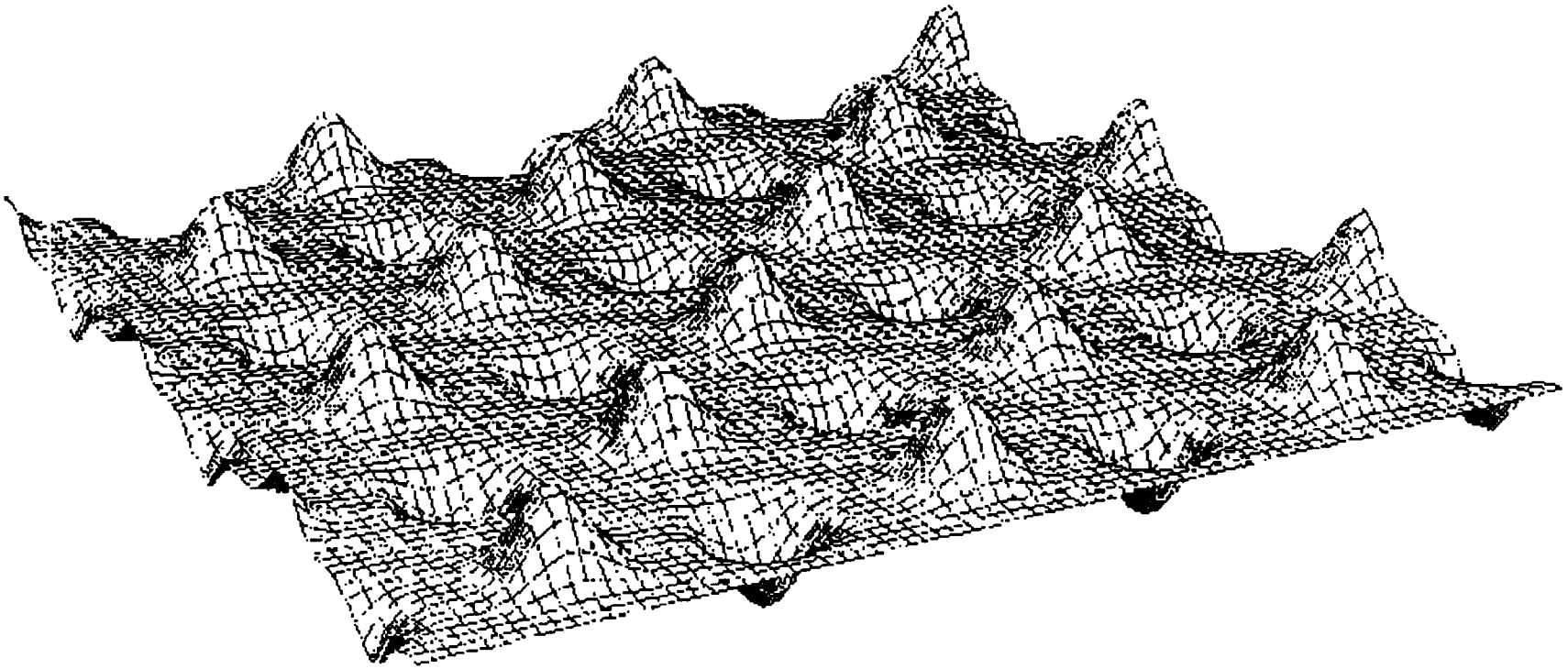
FIG. 16 is a perspective view of a barrier sheet material made according to another embodiment of the invention.
Figure 17:
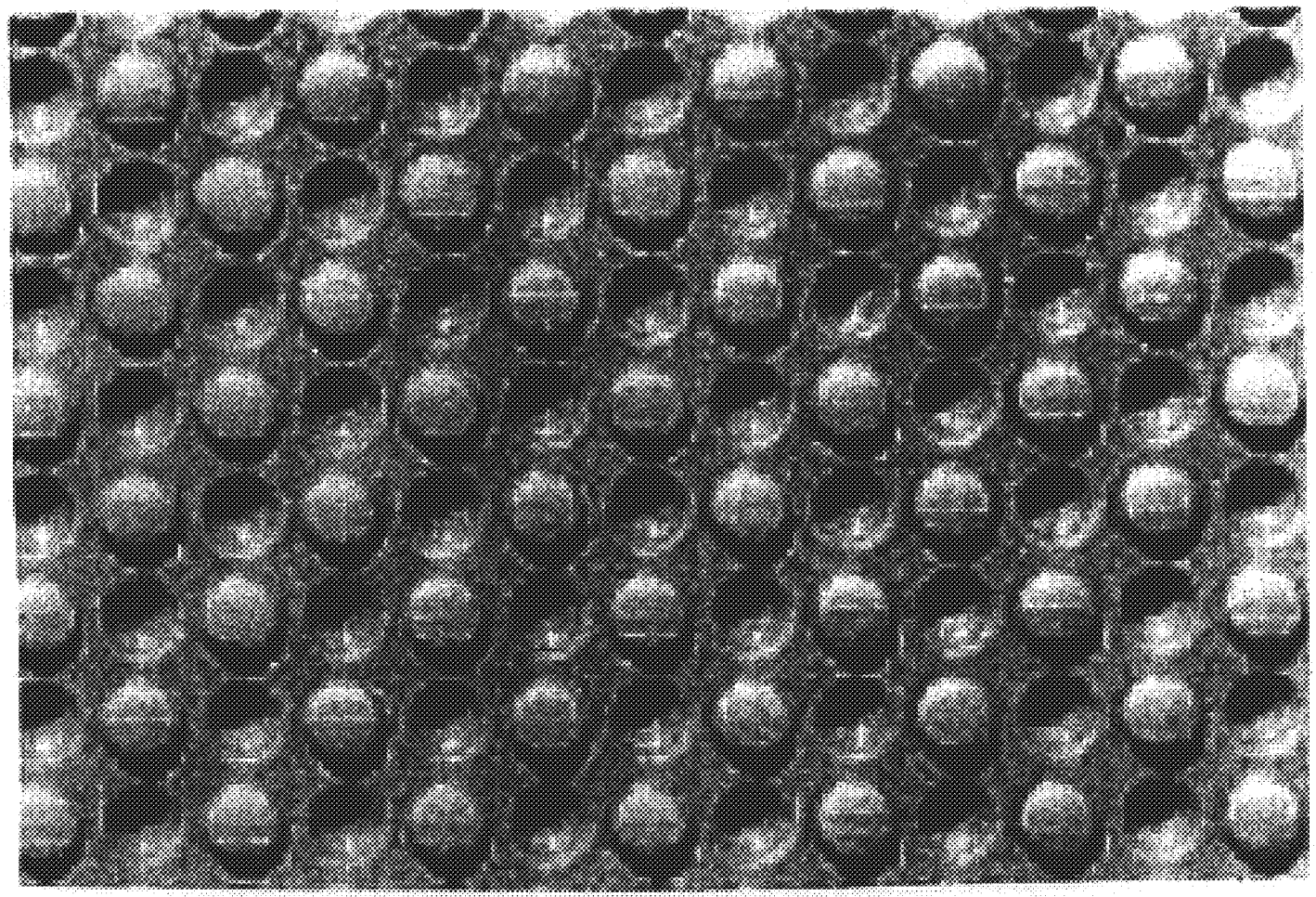
FIG. 17 is a photograph of one side of a barrier sheet material made according to another embodiment of the invention.

The protrusions may extend from one or both sides of the barrier sheet and preferably rise a distance of between 0.25 mm (9.8 mils) and 1.0 mm (39.4 mils) above one or both surfaces of the sheet prior to deformation of the sheet during embossing. The pattern created by the protrusions may be regular and repeated across the sheet, with all protrusions on each side of the sheet having the same size and shape and forming the same angles with the original plane of the sheet. For example, FIG. 16 shows a graphic representation of a sheet material having regular protrusions that extend out from both sides of the sheet. FIG. 17 shows a photograph of a sheet with dome-shaped protrusions extend from both surfaces of a sheet. Alternatively, the pattern created by the protrusions may be irregular or random, with each protrusion having a differing size and shape and forming differing angles with the original plane of the sheet. Such an irregular or random arrangement of protrusions requires a greater compressive force before collapsing than is the case with more regular protrusion patterns.

Figure 11:
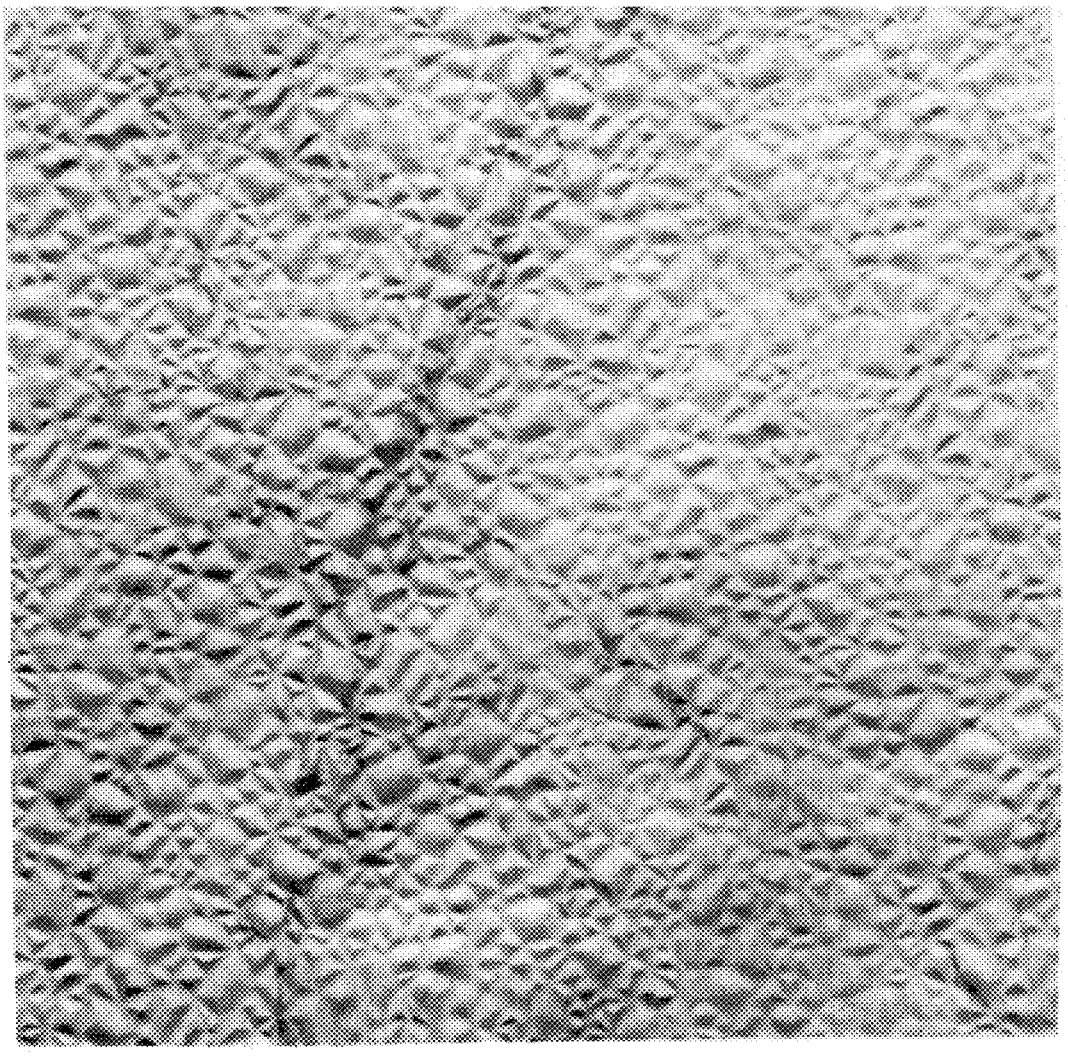
FIG. 11 is a photograph of one side of a barrier sheet material made according to one embodiment of the invention.
Figure 12:
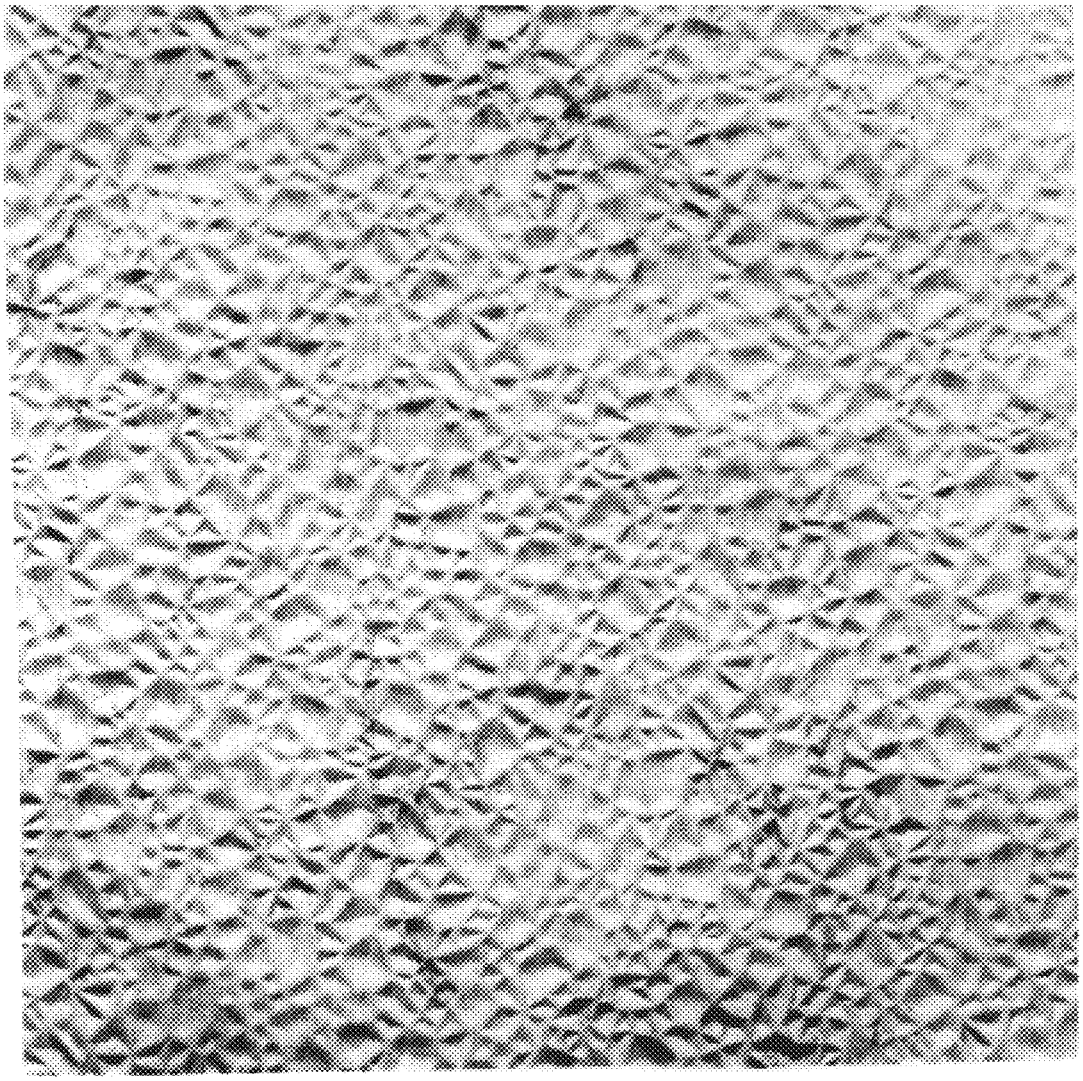
FIG. 12 is a photograph of the opposite side of the barrier sheet material shown in FIG. 11.
Figure 13:
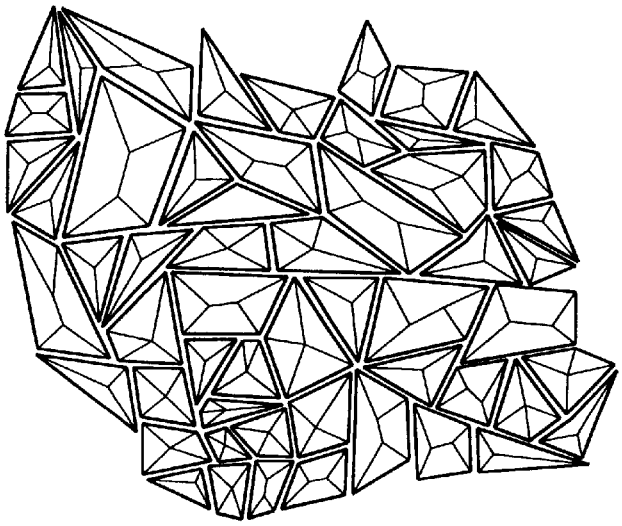
FIG. 13 is a schematic representation of a portion of the surface of the barrier sheet material shown in FIG. 11.
Figure 14:
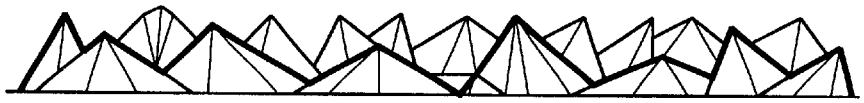
FIG. 14 is cross-sectional view of the sheet material shown in FIGS. 11–13.
Figure 15:
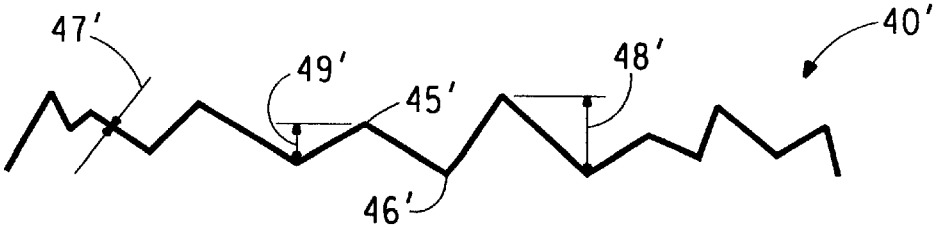
FIG. 15 is a view of the plane of the cross-sectional view shown in FIG. 14.

One preferred pattern of random embossed protrusions is shown in FIGS. 11–15. FIG. 11 is a photograph of the top surface of a spunbonded sheet embossed with random protrusions in which the protrusions extend out from the plane of the photograph. The protrusions are angular in nature and are of random sizes and shapes. FIG. 12 shows the back side of the sheet shown in FIG. 11. As shown schematically in FIG. 13, which is a view of a portion of the top of the sheet of FIG. 11, the protrusions have random polyhedral shapes that generally have between three and five surfaces that meet at the top of the protrusions to form peaks 45' (FIG. 15). Valleys 46' are formed between the surfaces of the protrusions. The angular protrusions create a three-dimensional surface on the barrier sheet in which substantially continuous drainage channels extend across the entire sheet and run in every direction, regardless of the angle from which the sheet is viewed. The pattern shown in FIGS. 11–15 is herein referred to as a "random polyhedral pattern". As best seen in the cross-sectional view shown in FIG. 14, the protrusions vary in height across the sheet. FIG. 15 shows just the plane of the cross section of the cross-sectional view of FIG. 14. The minimum peak height 49' (in FIG. 15) is preferably between about 0.3 mm (11.8 mils) and 0.5 mm (19.7 mils) above the original flat plane of the sheet, and the maximum peak height 48' is preferably between 0.5 mm (19.7 mils) and 0.8 mm (31.5 mils) above the original flat plane of the sheet. In the random polyhedral pattern shown in FIGS. 11–15, the angular protrusions are on just one side of the sheet. According to another preferred embodiment of the invention, the angular polyhedral protrusions may be on both sides of the sheet in a generally alternating pattern.

According to another embodiment of the invention, the integral channel means may be provided by laminating a netting, a scrim, a monofilament plastic line (fishing line), or a coarse nonwoven of high permeability directly to one or both sides of the barrier sheet. Alternatively, integral channel means may be provided by applying a random or regular array of individual spacers to one or both sides of the sheet material. The spacers may, for example, comprises small blobs or dots of a polymeric hot melt adhesive deposited on the sheet. Preferably, the spacers extend at least 200 microns above the surface of the sheet material to which they are applied, and more preferably at least 500 microns above the surface. Preferably, the spacers have a width of less than about 10 cm, and they are spaced between about 0.3 cm and 20 cm from each other.

Flat sheets that can be used in making the barrier sheet material of the invention include sheets of spunbonded synthetic fibers such as polyethylene, polypropylene or polyester fibers, sheets of spunbonded/meltblown/spunbonded ("SMS") polymer fibers, perforated polymer films, microporous film laminates, and building papers. Preferably, the barrier sheet material of the invention is made of a material that does not rot or readily lose its strength when subjected to the temperature and humidity conditions commonly experienced within the walls of structures over extended periods of time, as for example spunbonded sheets made of synthetic polymer fibers. As used herein the term "polymer" generally includes but is not limited to, homopolymers, copolymers (such as for example, block, graft, random and alternating copolymers), terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries.

Particularly well suited for making the barrier sheet material of the invention are substantially flat sheets of spunbonded nonwoven polyolefin film-fibrils of the type disclosed in U.S. Pat. No. 3,169,899. Such spunbonded sheets preferably have been thermally bonded as disclosed in U.S. Pat. No. 3,532,589, or have been calender bonded, as disclosed in PCT Publication No. WO 97/40224, in order to provide desired air barrier, water barrier, moisture vapor transmission, and strength properties. U.S. Pat. Nos. 3,169,899 and 3,532,589, and PCT Publication No. WO 97/40224, are each incorporated herein by reference. The term "polyolefin" is intended to mean any of a series of largely saturated open chain polymeric hydrocarbons composed only of carbon and hydrogen. Typical polyolefins include, but are not limited to, polyethylene, polypropylene, polymethylpentene and various combinations of the monomers ethylene, propylene, and methylpentene. The term "polyethylene" is intended to embrace not only homopolymers of ethylene but also copolymers wherein at least 85% of the recurring units are ethylene units. A preferred polyethylene polymer is a homopolymeric linear polyethylene which has an upper melting range limit of about 130° to 135° C., a density in the range of 0.94 to 0.98 g/cm$^3$ and a melt index (as defined by ASTM D-1238-57T, Condition E) of 0.1 to 6.0. The term "polypropylene" is intended to embrace not only homopolymers of propylene but also copolymers wherein at least 85% of the recurring units are propylene units.

A particularly preferred flat sheet for making the barrier sheet material of the present invention is TYVEK® spunbonded polyethylene sheet that has been thermal calender bonded as disclosed in PCT Publication No. WO 97/40224 to provide a flat sheet with the following properties:

- a basis weight of about 61 g/m$^2$ (1.8 oz/yd$^2$)
- a moisture vapor transmission rate, measured according to the LYSSY method, of about 700 g/m$^2$ in 24 hrs;
- a hydrostatic head of about 240 cm;
- a Gurley Hill porosity of greater than 500 seconds;
- a tensile strength of about 49 N/cm (28 lbs/in) in the machine direction and 49 N/cm (28 lbs/in) in the cross direction;
- an Elmendorf tear strength of about 8 N in the machine direction and 8 N in the cross direction; and
- an elongation of about 12% in the machine direction and 16% in the cross direction.

The preferred flat sheet material described above has a moisture vapor transmission rate that is lower than is conventionally found in TYVEK® HOMEWRAP™ sheet products. The moisture vapor transmission rate ("MVTR") of the flat sheet should be selected so as to obtain a desired end product MVTR after texturing has been completed. For example, the flat sheet is intentionally bonded to obtain a low moisture vapor transmission rate where the channel means is to be provided by means of creping the flat sheet because the creping process increases the moisture vapor transmission rate of the sheet material. TYVEK® spunbonded polyethylene sheet has the advantage that it does not rot or otherwise readily break down under the temperature and humidity conditions normally encountered when used within the walls of a structure.

Figure 2:
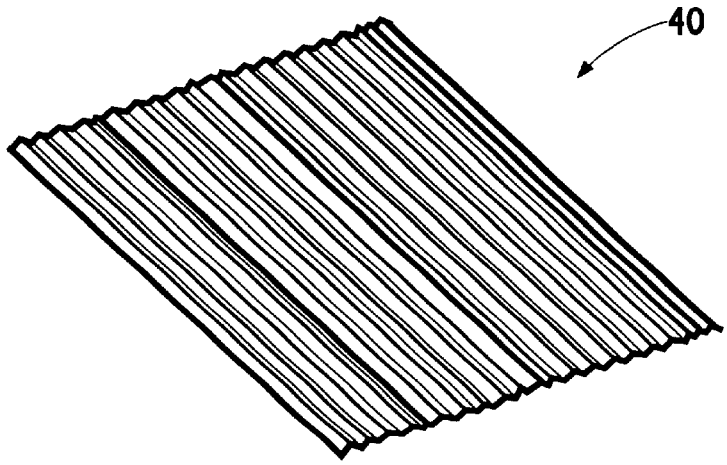
FIG. 2 is a perspective view of a barrier sheet material made according to one embodiment of the invention.
Figure 3:
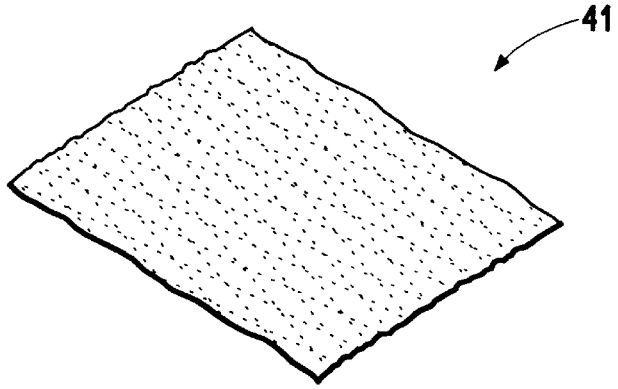
FIG. 3 is a perspective view of a barrier sheet material made according to another embodiment of the invention.
Figure 4:
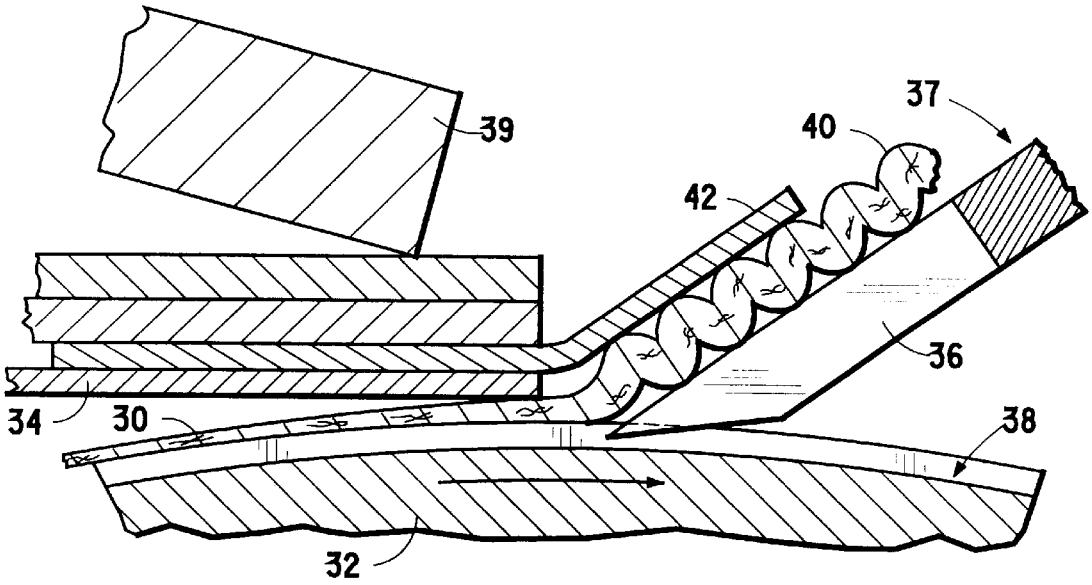
FIG. 4 is a cross-sectional view of a creping apparatus that can be used to make the barrier sheet material of the invention.

The embodiment of the barrier sheet material of the invention shown in FIG. 2 is formed by creping a flat sheet material like that described above. The sheet material can be creped by conventional creping methods. A preferred method for creping a flat spunbonded fibrous sheet is shown in FIG. 4 and is fully described in U.S. Pat. No. 4,090,385, which is hereby incorporated by reference. According to this method, a flat sheet 30 is fed from a supply roll (not shown) to a main roll 32 having either a flat surface or a grooved surface. A primary surface 34 presses the flat sheet 30 against the main roll 32. A pressure plate 39 applies a constant pressure to the flat sheet 30. A creping blade is positioned in front of the path of the flat sheet. A flat creping blade is used with a flat roll and a combed blade is used with a grooved roll. Where the creping blade is combed as shown in FIG. 4, each tooth 36 on the comb 37 has a tip that extends into one of the grooves 38 on the surface of the main roll 32.

After the flat sheet 30 passes the end of the primary surface 34, the sheet runs into the teeth of the comb 37 which divert the sheet 30 into the creping chamber and causes the sheet to bunch up and form a wavy grooved sheet 40. The amplitude of the waves (crest to trough), and the length of the waves, in the wavy grooved sheet 40 are initially determined by the amount of space between the surface of the main roll 32 and a flexible retarder 42 and the space between the crepe blade and the flexible retarder 42. The amplitude and length of the waves in the grooved sheet 42 is further adjusted by adjusting the speed of the take-up roll (not shown). The speed of the take-up roll is some fraction of the speed of the supply roll and the main roll 32. As the speed of the take-up roll gets closer to the speed of the supply and main rolls, the amplitude of the waves in the grooved sheet becomes smaller and the length of the waves becomes longer.

According to another embodiment of the invention, channels in the barrier sheet material can be made using a microstretching process. A process for microstretching a non-woven web is fully described in U.S. Pat. No. 4,223,059 which is hereby incorporated by reference. In the microstretching process, a spunbonded sheet is passed between two geared rolls. The teeth of the two geared rolls intermesh such that the teeth of one of the rolls project into the grooves between the teeth of the other of the rolls.

According to yet another embodiment of the invention, channels in the barrier sheet material can be made by forming protrusions in the sheet by way of a matched metal embossing process. Protrusions, such as those shown in FIGS. 11–17, can be generated in a barrier sheet made from the TYVEK® spunbonded polyethylene sheet described previously that has been thermal calendar bonded as disclosed in PCT Publication No. WO 97/40224 to provide a flat sheet, as for example a sheet of TYVEK® spunbonded polyethylene with the following properties:

- a basis weight of about 61 g/m$^2$ (1.8 oz/yd$^2$)
- a moisture vapor transmission rate, measured according to the LYSSY method, of between about 600 and 700 g/m$^2$ in 24 hrs;
- a hydrostatic head of about 280 cm (110.2 in);
- a Gurley Hill porosity of greater than 800 seconds;
- a tensile strength of about 50.8 N/cm (29 lbs/in) in the machine direction and 47.3 N/cm (27 lbs/in) in the cross direction;
- an Elmendorf tear strength of about 8 N (1.8 lbs) in the machine direction and 8 N (1.8 lbs) in the cross direction; and
- an elongation of about 10% in the machine direction and 13% in the cross direction.

A process for embossing the spunbonded sheet described above using matched metal rolls is shown in FIG. 18 and disclosed in U.S. Pat. No. 5,129,813, which is hereby incorporated by reference. A spunbonded sheet 100, such as a sheet of TYVEK® spunbonded polyethylene, is unwound from roll 101 and passed over tensioning rolls 102, 103, and 104. The sheet is next heated to the softening temperature of the sheet in a heating section 108. The heating section 108 may comprise any conventional method for rapidly heating a sheet such as convection heating, radiant heating, infrared heating, hot air heating, hot roll heating, or some combination thereof. It is important that the sheet not be heated to a temperature greater than the melt temperature of the sheet (e.g., 275° F. (135° C.) for TYVEK® spunbonded polyethylene sheet).

Figure 19:
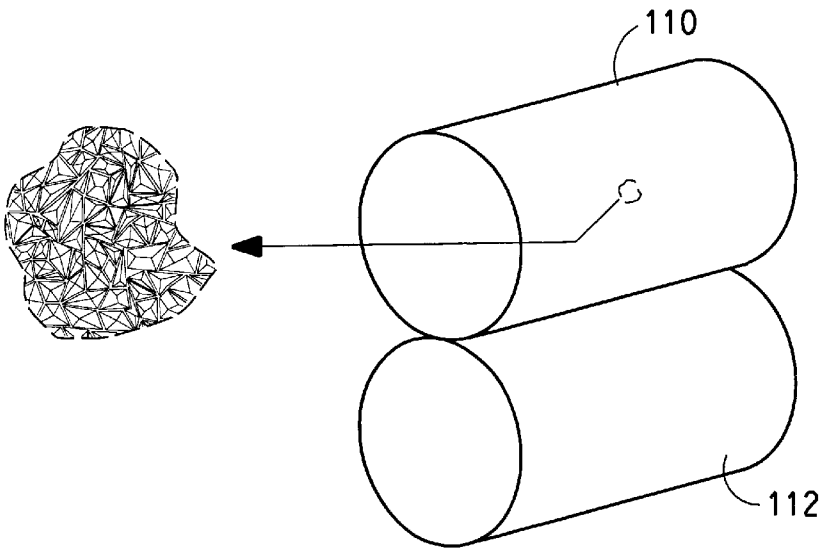
FIG. 19 is a perspective view of embossing rollers that can be used in the process shown in FIG. 18.

The sheet is next passed between two engraved steel rolls 110 and 112. The rolls 110 and 112 are preferably cooled quench rolls that are about 10 feet (3.05 m) long, about 1.5 feet (0.46 m) in diameter, and have a surface that promotes heat transfer out of the sheet such as a steel, ceramic, or chrome surface. A roll 110 is engraved with angular polyhedral protrusions extending out from the surface of the roll. As best seen in FIG. 19, the protrusions on the roll 110 vary in height, shape and size uniformly over the surface of the roll and are preferably between 20 and 30 mils in height. An abutting roll 112, the surface of which is not shown in FIG.

19, is made with depressions that correspond to the protrusions on the roller 110. The rolls 110 and 112 intermesh in a manner such that the protrusions engraved on the surface of the roll 110 project into the mirror image cavities engraved on the surface of the roll 112. Where it is desired that the sheet have protrusions on both sides of the sheet, each of the rolls 110 and 112 are made with protrusions and depressions that engage and compliment corresponding depressions and protrusions and on the other roll. The rolls 110 and 112 are geared to each other so as to turn together at exactly the same rate. The two rolls are separated by a very small gap of about 1 to 10 mils (0.025 to 0.254 mm) when there is no sheet between them.

When the flat spunbonded sheet 100 passes between the two engraved rolls 110 and 112, the pattern that is engraved on the surface of the male roll 110 is impressed on the flat sheet 100 such that a textured sheet 40' is produced. After exiting the embossing rolls 110 and 112, the textured sheet 40' passes over a series of cooling rolls 113, 114, and 115 that reduce the temperature of the sheet below the sheet's softening temperature.

The line speed for the above process is generally between 100 feet per minute (fpm) (30.5 m/min) and 200 fpm (61 m/min), with speeds near 100 fpm (30.5 m/min) yielding maximum pattern depth and crispness. As line speed is increased towards 200 fpm (61 m/min), it is necessary to heat the sheet more quickly in the heating section 108 in order to maintain maximum pattern depth and crispness.

A barrier sheet 40' was embossed with a random polyhedral pattern by the process described immediately above and is shown in FIGS. 11–15. The basis weight of the sheet is typically increased from about 61 g/m$^2$ to about 65 g/m$^2$ by the embossing process. The sheet material maintains its thickness 47' (FIG. 15) at between about 5 and 6 mils (0.127 and 0.152 mm). The maximum vertical distance 48' between the highest peaks and the lowest valleys ranges between 14 and 22 mils (0.36 and 0.56 mm). The maximum vertical distance 49' between the lowest peaks and the highest valleys ranges between 9 and 17 mils (0.229 and 0.432 mm). The angular protrusions create a three-dimensional surface on the barrier sheet so as to form substantially continuous drainage channels that extend across the entire sheet and run in all directions, regardless of the angle from which the sheet is viewed. This textured sheet 40' has the following properties:

- a basis weight of about 64.4 g/m$^2$ (1.9 oz/yd$^2$)
- a moisture vapor transmission rate, measured according to the LYSSY method, of between about 900 and 1200 g/m$^2$ in 24 hrs;
- a hydrostatic head of about 241 cm (94.9 in);
- a Gurley Hill porosity of about 400 seconds;
- a tensile strength of about 63 N/cm (36 lbs/in) in the machine direction and 55.2 N/cm (31.5 lbs/in) in the cross direction;
- an Elmendorf tear strength of about 5.3 N in the machine direction and 6.2 N in the cross direction; and
- an elongation of about 16% in the machine direction and 19% in the cross direction.

According to another embodiment of the invention, a barrier sheet with a grooved surface can be made by passing a flat spunbonded sheet between two corrugating rolls similar to the matched metal embossing rolls described above. The corrugating rolls have complementary grooved surfaces wherein the grooves can be straight or wavy. The amplitude of the raised grooves on each of the rolls and the depth of the complementary groove channels on the opposite roll can made to increase and decrease such that the amplitude of the grooves formed in the sheet material will fluctuate over the length of each groove. Preferably, the fluctuations in the amplitude of each of the grooves in the sheet are coordinated so that the low amplitude portions of the grooves formed on the sheet align in a manner so as to form channels on the surfaces of the sheet, which channels are generally perpendicular to the direction of the grooves. Preferably, the corrugating rolls are heated so as to maintain a synthetic spunbonded sheet being corrugated at or near the sheet's softening temperature during the corrugation process. Optionally, the rolls can be steam heated rolls that have small steam ports over the entire roll surfaces through which steam can be directly injected into the sheet being corrugated so as to more thoroughly heat the sheet being corrugated.

Figure 20:
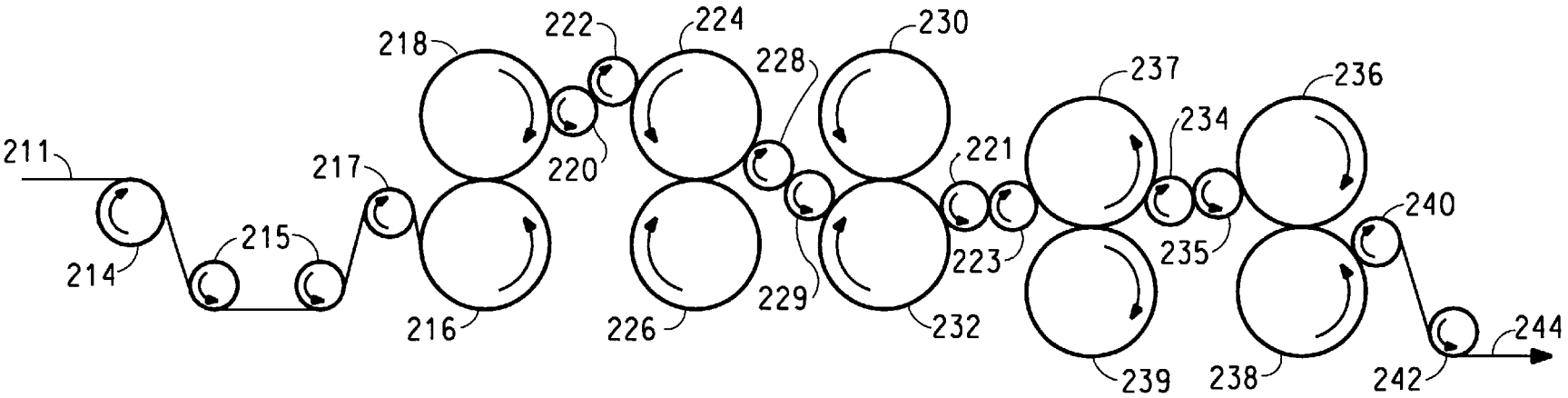
FIG. 20 is a schematic representation of another process for producing the barrier sheet material of the invention.

In another preferred process for producing a textured barrier sheet material, a synthetic fibrous sheet can be bonded and textured in the single in-line bonding and texturing process shown in FIG. 20. According to the process shown in FIG. 20, the bonding process takes place in four general operations. First, rolls 216 and 218 preheat the sheet. Second, rolls 224 and 226 calender bond one side of the sheet and rolls 230 and 232 calender bond the opposite side of the sheet. Third, embossing rolls 237 and 239 texture the sheet. Fourth, rolls 236 and 238 cool and stabilize the sheet. The relative speeds of each of the rolls is controlled such that a desired level of tension is maintained in the sheet as it is being bonded and textured. The bonding and texturing process is complete by the time the bonded sheet 244 comes off the cooling roll 238.

According to the preferred bonding and texturing process of the invention, the lightly consolidated sheet is first heated against one or more preheating rolls. According to the preferred embodiment of the invention, sheet 211 is guided by one or more fixed rolls 215 as the sheet travels from a feeder roll 214 to the first of two preheating rolls. Preferably, a fixed roll 217 guides the sheet 211 to a position on the heated roll 216 such that the sheet contacts a substantial portion of the circumference of roll 216. The sheet preferably travels from the first preheating roll 216 to second preheating roll 218. An adjustable wrap roll 220 is provided that is positioned close to the surface of roll 218, but that can be moved relative to the surface of roll 218 so as to permit adjustment of the distance over which the sheet and the preheating roll 218 are in direct contact. The position of wrap roll 220 relative to the surface of roll 218 is expressed in the examples below as the angle formed between a line passing through the centers of rolls 218 and 220 and a horizontal line passing through the center of roll 218. Fixed roll 217 could likewise be replaced by an adjustable wrap roll to permit additional adjustment of the distance over which the sheet contacts preheating roll 216.

Preheating rolls 216 and 218 preferably have a diameter that is large enough to provide good preheating of the sheet, even at relatively high sheet travel speeds. At the same time, it is desirable that rolls 216 and 218 be small enough such that the force of the sheet against the surface of the roll, in a direction normal to the roll surface, is great enough to generate a frictional force sufficient to resist sheet shrinkage. The force of the sheet against the roll in the direction normal to the roll surface is a function of the tension in the sheet and the diameter of the roll. As roll size increases, a greater sheet tension is required to maintain the same normal force. The frictional force that helps resist sheet shrinkage during bonding is proportional to the sheet force against the roll in the direction normal to the surface of the roll. Preferably, rolls 216 and 218 are heated by hot oil pumped through an annular space under the surface of each roll. Alternatively, rolls 216 and 218 could be heated by other means such as electric, dielectric or steam heating. When a fully bonded sheet product is desired, the preheating roll surfaces are preferably heated to a temperature within 15° C. of the melting point of the sheet material being bonded.

As used herein, the term "fully bonded sheet" refers to a sheet structure in which the fibers of the sheet are bonded to other fibers throughout the thickness of the sheet. Fibers are "bonded" when the fibers are connected or welded to other fibers in the sheet at a substantial majority of the points where the fibers of the sheet contact each other. In a very fully bonded fibrous sheet, most of the fibers are connected or welded to numerous other fibers in the sheet, and the sheet exhibits a hard paper-like feel. For example, when fully bonding a flash-spun polyethylene sheet, the preferred range of operating temperatures for the preheating rolls is 121° to 143° C. (250° to 290° F.). When a soft structure product with low internal bonding is desired, preheating rolls 216 and 218 are maintained at a temperature well below the sheet's melting temperature or even at ambient temperature. By adjusting the preheating roll temperature and the residence time of the sheet on the preheating rolls (by adjusting the roll speed and the position of the wrap roll 220), the temperature of the sheet going into the calendering operation can be carefully controlled.

The sheet tension and the friction between the sheet and rolls (which is a function of the sheet tension and roll size, as discussed above) combine to minimize sheet shrinkage or curling during the preheating step. Sheet curling arises when a sheet is not uniformly heated such that one side of a sheet shrinks more than the opposite side. Sheet tension arises from sheet shrinkage that occurs with heating and from increasing the linear surface speed of subsequent rolls. The roll speed differentials may be adjusted so as to achieve a desired sheet tension. The linear surface speed of rotating preheating roll 216 is preferably as fast as, or slightly faster than, the speed at which sheet 211 passes over feed roll 214. A small differential in roll surface speeds helps to maintain the sheet tension during preheating. Likewise, the surface of preheating roll 218 preferably moves at a linear speed as fast as, or slightly faster than, the surface speed of roll 216 to help maintain sheet tension on and between the preheating rolls. Preferably, the linear surface speed of roll 216 is at least about 0.2% faster than the linear surface speed of the feed roll 214, and more preferably about 0.5% faster than the linear surface speed of feed roll 214. Similarly, the linear surface speed of the second preheating roll 218 is preferably about 0.2% faster than the surface speed of the first preheating roll 216, and more preferably about 0.5% faster than the surface speed of the first preheating roll 216.

Shrinkage and curling of the sheet, as the sheet passes between rolls, are minimized by keeping the spans between rolls where the sheet is free of a roll surface to a minimum. Shrinkage and curling are also controlled by maintaining the sheet under tension in such free sheet spans. The smaller the diameter of preheating rolls 216 and 218, and wrap roll 220, and the closer the spacing of the rolls, the shorter are the free spans of the sheet between the rolls. Preferably, the free span of the sheet being bonded between preheating rolls 216 and 218 is less than about 20 cm (7.9 in), and more preferably less than about 8 cm (3.2 in). For example, the free span between two 0.5 m diameter rolls spaced 0.6 cm from each other would be 7.8 cm.

The preheated sheet is next transferred to a thermal calender roll 224. In making the transfer from preheating roll 218 to calender roll 224, the sheet preferably passes over two adjustable wrap rolls 220 and 222. The free sheet spans between rolls 218 and 220, rolls 220 and 222, and rolls 222 and 224 should be kept to a minimum in order to control sheet shrinkage and curling. The use of small diameter wrap rolls 220 and 222, with diameters in the range of 15 to 25 cm (6 to 10 in), helps to minimize free sheet spans. Preferably, each of the free sheet spans between rolls 218 and 224 is less than 20 cm (7.9 in), and more preferably less than about 8 cm (3.2 in).

The tension in the sheet must be maintained as the sheet passes from preheating roll 218 to calender roll 224. Preferably, the linear surface speed of calender roll 224 is as fast as, or slightly faster than, the surface speed of preheating roll 218 to help maintain sheet tension in the free sheet spans between the preheating roll 218 and the calender roll 224, to maintain the sheet tension on the flexible wrap rolls 220 and 222, and to help maintain the sheet tension on the heated calender roll 224. The linear surface speed of calender roll 224 is preferably at least about 0.2% faster than the linear surface speed of preheating roll 218, and more preferably about 0.5% faster than the surface speed of feed roll 218. It is further preferred that the linear surface speed of calender roll 224 be no more than 2% faster than the speed of roll 218 in order to prevent stretching of the sheet. The position of the wrap roll 222 is adjustable along the surface of roll 224 for adjusting the degree of contact between the sheet being bonded and the heated calender roll 224. The position of wrap roll 222 relative to the surface of calender roll 224 is expressed in the examples below as the angle formed between a line passing between the centers of rolls 222 and 224 and a horizontal line passing through the center of roll 224. The surfaces of the wrap rolls used in the process of the invention (as well as the small fixed rolls) may each be machined with two spiral grooves that are oppositely directed away from the middle of the roll toward the opposite edges of the roll. The spiral grooves help keep the sheet spread in the cross direction which reduces cross-directional sheet shrinkage.

Preferably, calender roll 224 is heated by hot oil that is pumped through an annular space under the surface of the roll, but it may be heated by any of the means discussed above with regard to the preheating rolls. Where a fully bonded sheet is desired, the roll surface is preferably heated to a temperature within 10° C. of the melting temperature of the sheet material being bonded. For example, when a fully bonded flash-spun polyethylene sheet is desired, the preferred range of operating temperatures for the surface of roll 224 is from 130° to 146° C. (266° to 295° F.). Because the sheet has been preheated before reaching the calender roll 24, it is not necessary to use excessive calender roll temperatures to force high energy fluxes into the sheet. The application of such high energy fluxes is frequently undesirable in the bonding of web structures because high energy fluxes tend to cause excessive melting on the web surface.

The sheet being bonded is passed through a nip formed between the heated calender roll 224 and a back-up roll 226. In the preferred embodiment, the back-up roll 226 is an unheated roll with a resilient surface. However, it is contemplated that back-up roll 226 could have a hard surface and it is also contemplated that roll 226 could be a heated roll. The surface of back-up roll 226 moves at substantially the same speed as roll 224. The hardness of the resilient surface is selected in accordance with the desired nip size and pressure. A harder surface on roll 226 results in a smaller nip area. The amount of bonding in the nip is a function of the nip size and nip pressure. If a lightly bonded soft product is desired, the pressure in the nip between rolls 224 and 226 is kept low or roll 226 can be lowered to open up the nip altogether. Where it is desired to produce a more fully bonded product, such as a very fully bonded hard sheet, the nip pressure can be increased. For example, when a lightly consolidated sheet of flash-spun polyethylene is being bonded to form a fully bonded sheet product suitable for use as an air infiltration barrier housewrap material, a nip pressure in the range of 18–54 kg/linear cm (100–300 lbs/linear inch) is preferred. A fully bonded sheet flash-spun polyethylene material generally has a delamination strength in excess of 14 N/m (0.08 lbs/in).

The surface of heated calender roll 224 is selected such that the coefficient of friction between the roll and the heated sheet is high enough to resist sheet shrinkage. At the same time, the roll surface must readily release the sheet without sticking or picking of fibers. In the preferred embodiment of the invention, heated calender roll 224 has a smooth surface of a Teflon®-filled chrome material. If a bonding pattern is desired for the top surface of the sheet being bonded, the smooth calender roll may be replaced by a patterned roll. Chrome and Teflon® coated rolls finished by Mirror Polishing and Plating Company of Waterbury, Conn., have been successfully used in the calendar operation of the invention. Back-up roll 226 is preferably a hard rubber-surfaced roll with a surface hardness in the range of 260 on the Shore A Hardness Scale to 90 on the Shore D Harness Scale, as measured on an ASTM Standard D2240 Type A or D durometer. More preferably, back-up roll 226 has a surface hardness of 80 to 95 on the Shore A Hardness Scale.

The process shown in FIG. 20 includes the step of passing the sheet through a second calender nip for bonding the side of the sheet opposite to the side bonded in the first nip associated with roll 224. Of course, if it is desired that a sheet product be bonded primarily on just one side, then one of the two nips can be operated in an open position or eliminated entirely. When a second nip is utilized, the sheet is transferred from the first calender roll 224 to a second heated calender roll 232. In making the transfer from roll 224 to roll 232, the sheet passes over a fixed roll 228 and an adjustable wrap roll 229. The free sheet spans between rolls 224 and 228, rolls 228 and 229, and rolls 229 and 232 are kept to a minimum in order to control sheet shrinkage and curling. The use of a small diameter fixed roll 228 and wrap roll 229, in the range of 15 to 25 cm (6 to 10 in), help to keep the free sheet spans to a minimum. It is important that tension be maintained in the sheet between rolls 224 and 232.

Preferably, the linear surface speed of calender roll 232 is as fast as, or slightly faster than, the surface speed of calender roll 224 to help maintain sheet tension in the free sheet spans between the first and second calendering operations, to maintain the sheet tension on the fixed roll 228 and wrap roll 229, and to help maintain the sheet tension on the heated calender roll 232. The preferred linear surface speed of roll 232 is at least about 0.2% faster than the linear surface speed of calender roll 224, and more preferably about 0.5% faster than the linear surface speed of feed roll 224. It is further preferred that the linear surface speed of calender roll 232 be no more than 2% faster than the speed of calender roll 224 in order to prevent stretching of the sheet. The surface speed of back-up roll 230 is substantially equal to the surface speed of calender roll 232.

The position of the wrap roll 229 is adjustable along the surface of roll 232 for adjusting the degree of contact between the sheet being bonded and the heated calender roll 232. The position of wrap roll 229 relative to the surface of calendar roll 232 is expressed in the examples below as the angle between a line passing through the centers of rolls 229 and 232 and a horizontal line passing through the center of roll 232. Again, the surface of fixed roll 228 and wrap roll 229 may each be machined with two spiral surface grooves directed away from the middle of the rolls to help maintain cross-directional sheet tension.

Heated calender roll 232 is preferably similar to the heated calender roll 224 and the back-up roll 230 is preferably similar to the resilient-surfaced back-up roll 226, as described above. The temperature of the rolls 224 and 232, the finish on the surface of the rolls 224 and 232, the pressure of the corresponding nips, the hardness of back-up rolls 226 and 230, and the degree of sheet wrap on the heated calender rolls can all be adjusted in order to achieve a desired type and degree of sheet bonding. For example, if hard, fully bonded, smooth-surfaced sheets are desired, both of the rolls 224 and 232 should be smooth heated calender rolls operated within the melting temperature range for the sheet material being bonded and relatively high nip pressures should be applied at both nips. If a lightly bonded softer product is desired, the temperature of the preheating rolls and the calendering rolls can be reduced, the degree of sheet wrap on the preheating and calender rolls can be reduced, and the nip pressures can be reduced in order to decrease the degree of bonding in the sheet.

The process shown in FIG. 20 includes the step of passing the sheet between two embossing rolls in order to texture the sheet. The embossing rolls 237 and 239 are preferably like the embossing rolls 110 and 112 described above with reference to FIGS. 18 and 19. The calender bonded sheet is transferred from the second calender roll 232 to an embossing roll 237. In making the transfer from roll 232 to roll 237, the sheet passes over wrap rolls 221 and 223. The free sheet spans between rolls 232 and 221, rolls 221 and 223, and rolls 223 and 237 are kept to a minimum in order to control sheet shrinkage and curling. The use of a small diameter wrap rolls 221 and 223, in the range of 15 to 25 cm (6 to 10 in), help to keep the free sheet spans to a minimum. It is important that tension be maintained in the sheet between rolls 232 and 237. If it is necessary to further heat the sheet prior to the embossing step, such additional heating can be accomplished by further heating the sheet by any of the means discussed above, including convection heating, radiant heating, infrared heating, hot air heating, hot roll heating, or some combination thereof.

Preferably, the linear surface speed of the embossing rolls 237 and 239 are as fast as, or slightly faster than, the surface speed of calender roll 232 to help maintain sheet tension in the free sheet spans between the second calendering operation and the embossing operation. The preferred linear surface speed of roll 237 is at least about 0.2% faster than the linear surface speed of calender roll 232, and more preferably about 0.5% faster than the linear surface speed of feed roll 232. It is further preferred that the linear surface speed of embossing rolls 237 and 239 be no more than 2% faster than the speed of calender roll 232 in order to prevent stretching of the sheet.

In order to stabilize the bonded and embossed sheet (i.e., prevent curling or any additional shrinkage), the sheet is transferred from embossing roll 237 to a set of one or more cooling rolls. The cooling operation rapidly reduces the sheet temperature so as to stabilize the bonded sheet. In the preferred embodiment of the invention shown in FIG. 20, two cooling rolls 236 and 238 are used to quench the heated sheet. In making the transfer from embossing roll 237 to cooling roll 236, the sheet preferably passes over two small fixed transfer rolls 234 and 235. The free sheet spans between rolls 237 and 234, between rolls 234 and 235, and between rolls 235 and 236 are kept to a minimum in order to control sheet shrinkage and curling. Preferably, small transfer rolls of 15 to 25 cm in diameter are used in order to reduce the free sheet spans between rolls 237 and 236 to less than about 20 cm (7.9 in), and more preferably to less than 8 cm (3.2 in). The surface speed of cooling roll 236 is preferably as fast as, or slightly faster than, the surface speed of embossing rolls 237 and 238 to help maintain sheet tension in the free sheet spans between the embossing operation and the cooling operation, to maintain sheet tension on the rolls 234 and 235, and to help maintain the sheet tension on the cooling roll 236. The preferred surface speed of cooling roll 236 is at least about 0.2% faster than the surface speed of calender roll 232, and more preferably about 0.5% faster than the surface speed of calender roll 232. Again, the surface of rolls 234 and 235 may each be machined with two spiral surface grooves directed away from the middle of the rolls to help maintain cross-directional sheet tension.

Cooling rolls 236 and 238 are preferably of a diameter similar to that of the preheating rolls 216 and 218. The rolls must be large enough to have the strength to resist bending and to provide a residence time for the sheet on the rolls sufficient for adequate cooling. On the other hand, it is desirable for the rolls to be small enough that the force of the sheet against the rolls is sufficient to generate shrinkage resisting friction between the sheet and cooling rolls (as discussed above). The cooling rolls should be close enough that the free sheet span between the rolls is as small as possible. It is also important to maintain the sheet tension on and between cooling rolls, as for example by operating roll 238 at a surface speed as fast as, or slightly faster than, the surface speed of roll 236.

The rolls 236 and 238 cool opposite sides of the sheet. The rolls are preferably cooled by cooling water that passes through an annular space under the surface of each roll. The temperature of the cooling water pumped into the rolls is preferably at least 20° C. below the melting point of the sheet material, and more preferably at least 25° C. below the melting point of the sheet material. Where the process of the invention is used for bonding polyethylene plexifilamentary sheet, cooling roll temperatures between about 10° and 43° C. (50° and 110° F.) have been found to work well. If the sheet being bonded is a polyethylene plexifilamentary sheet, it is desirable for the temperature of the sheet to be reduced to a temperature below about 100° C. (212° F.) before coming off the cooling rolls. The cooling rolls preferably have a non-sticky surface such as a smooth polished chrome finish from which the bonded sheet 244 is easily removed.

The bonded sheet 244 is transferred to a take-up roll or to subsequent downstream processing steps, such as printing, by means of transfer rolls, such as the fixed rolls 240 and 242 shown in FIG. 20. After the sheet comes off the cooling rolls 236 and 238 and sheet bonding is complete, so it is no longer necessary to keep free sheet spans to an absolute minimum or to maintain sheet tension in order to resist sheet shrinkage and curling.

When the textured barrier sheet material of the invention is used in a siding-faced wall construction and nails are hammered through the sheet material, the pressure of the siding against the sheet material around the area where the nail passes through the barrier sheet flattens out the sheet and blocks the channels around the nail hole. Thus, one apparent benefit of the invention is that water moving down the barrier sheet on the siding side of the sheet is directed away from nail holes by blockages in the sheet channels in the area around the nail holes. The water finds its way to open channels that are away from nail holes. When the barrier sheet material of the invention is used with siding applications, water that gets into the space between the siding and the sheet material will be drained from the wall by the force of gravity through the channels on the exterior side of the barrier sheet. In the event that water that finds its way between the barrier sheet and the structure, channels on the structure side of the sheet material can allow water to drain water from the wall. In addition, it is believed that the small amount of air space in the channels of the sheet material improves the distribution of moisture behind the barrier sheet which in turn improves the transmission of moisture vapor out from behind the barrier sheet. Thus, moisture vapor, which can cause condensation, is much less likely to build up on the structure side of the channeled barrier sheet.

Figure 6:
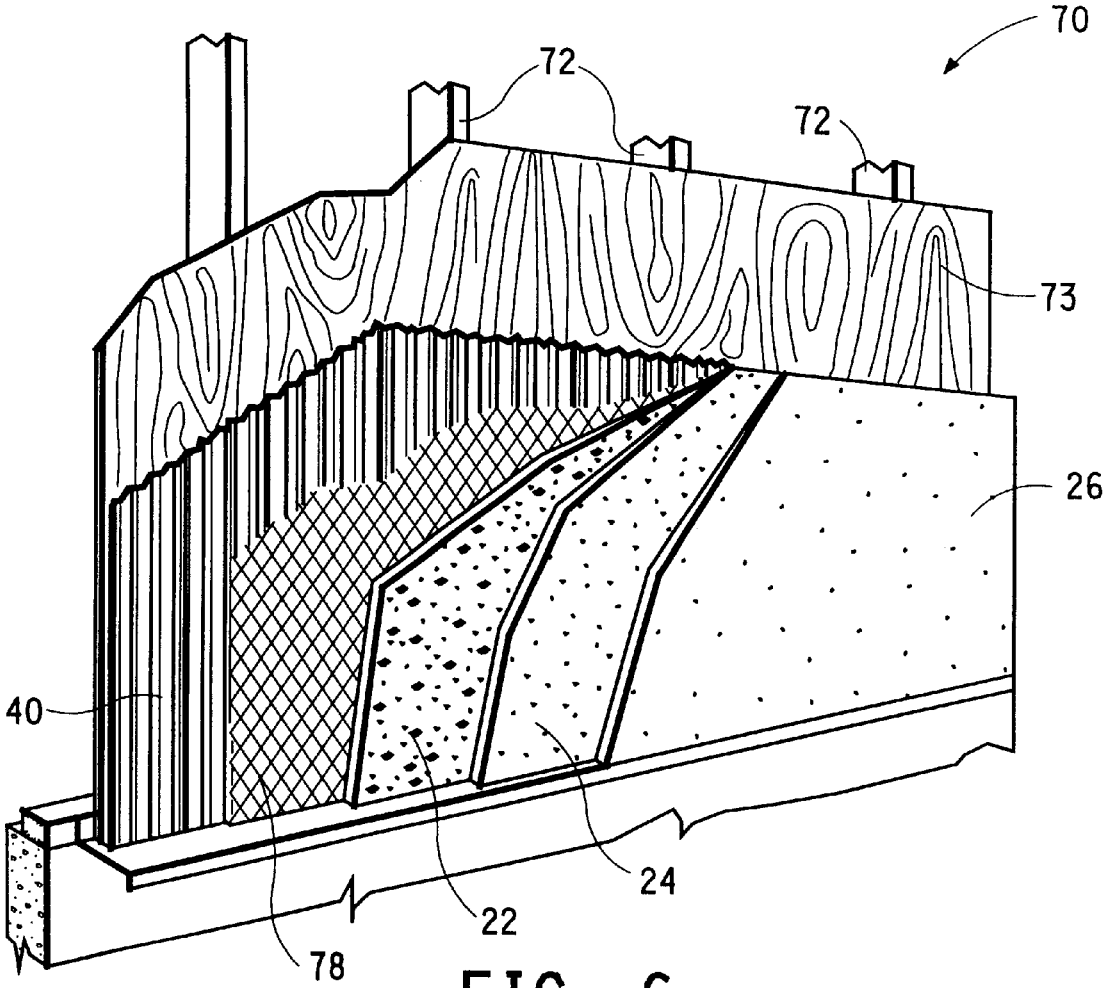
FIG. 6 is a cut away view of a stucco-faced wall construction over wood sheathing board made according to the present invention.

FIG. 6 shows the barrier sheet material of the invention incorporated into a stucco-faced wall construction 70. In the stucco-faced wall construction 70 shown in FIG. 6, the studs 72 of the structure are covered with a sheathing material 73, such as plywood. The sheathing 73 is covered with a barrier sheet 40 as shown in FIG. 2. While the barrier sheet 40 is shown as a grooved sheet, any of the other embodiments of the barrier sheet of the invention, such as the corrugated or random polyhedral patterns described above, can be used in place of the grooved sheet. The barrier sheet may be glued, stapled, nailed, taped or otherwise mechanically fastened to the sheathing 73. A metal lath 78, such as a woven "chicken wire", is applied over the textured barrier sheet 40 and attached to the sheathing 73 and/or the studs 72 with furring nails (not shown). A scratch coat 22 of stucco is applied over the wire lath 78 so that the stucco passes through the lath and contacts the barrier sheet 40. After the scratch coat has had an opportunity to dry, an intermediate brown coat 24 of stucco is applied over the scratch coat 22. Once the brown coat has had an opportunity to dry, finish coat 26 of stucco is applied over the brown coat 24. If exterior color is desired, the finish coat 26 may be pigmented or the surface of the finish coat may be painted.

Because the barrier sheet 40 is a synthetic sheet that does not absorb water from the curing stucco, as occurs when an asphalt saturated kraft paper is used as the barrier sheet, cracking resulting from dehydrating the stucco too quickly is also avoided. Also, because the preferred synthetic barrier sheet 40 does not absorb water, the sheet does not buckle during the stucco curing process, which buckling contributes to cracking of the stucco applied over water-absorbing building papers. One other advantage of the preferred barrier sheet of the invention is that it is mostly white and therefore does not heat up in the sun nearly as much as is the case with asphalt saturated papers. If the barrier sheet material is cooler at the time the stucco is applied, crack inducing rapid dehydration of the stucco is less likely to occur. Another important benefit of using the grooved barrier sheet 40 shown in FIG. 2 behind stucco is that the creped barrier sheet 40 can expand and contract in an accordion-like fashion when stucco bonded to the surface of the barrier sheet expands or contracts. This is especially important during the period when the stucco is curing when the barrier sheet's flexibility prevents much of the cracking that is frequently encountered during the curing of a stucco surface.

In stucco faced walls, another important advantages of the barrier sheet 40 is that the barrier sheet can be made with vertically oriented air channels behind the barrier sheet through which water can drain from the wall. If bulk water somehow finds its way behind the barrier sheet, the water will be drained from the wall through the channels by the force of gravity. In addition, it is believed that the small amount of air space in the channels behind the sheet material improves the the distribution of moisture behind the barrier sheet, which in turn is believed to improve the transmission of moisture vapor out through the barrier sheet. Without wishing to be bound by theory, it is believed that the air space behind the sheet helps to spread moisture vapor coming out of the structure over a wider area of the barrier sheet such that the water vapor can more readily be transmitted out through the sheet and stucco. In addition, some moisture vapor is believed to actually pass out of the channels without having to pass through the barrier sheet and the stucco.

In instances where the stucco is wet, as for example after a heavy rain, moisture vapor in the stucco can diffuse through the barrier sheet into the air space between the backsheet and the sheathing of the structure. Accordingly, bulk water in the wall and moisture vapor in the stucco or the wall are more readily passed out of the walls. This more rapid discharge of water and water vapor from the wall reduces the rot, mold and mildew in stucco-faced walls. Importantly, the air space between the barrier backsheet and the remainder of the wall also have been found to form an effective break that helps prevent the transfer of moisture by capillary action from a wet exterior layer of a wall to the wall's sheathing, studs and insulation.

Figure 7:
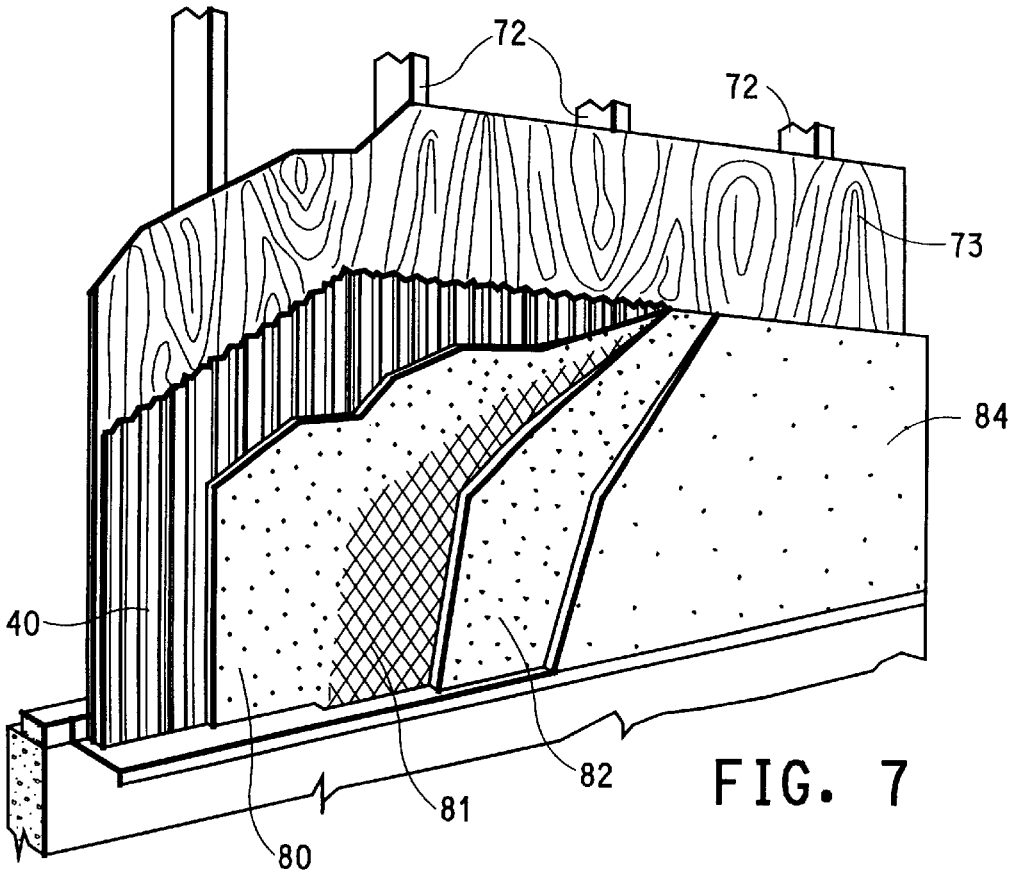
FIG. 7 is a cut away view of an EIFS or hybrid wall construction made according to the present invention.
Figure 8:
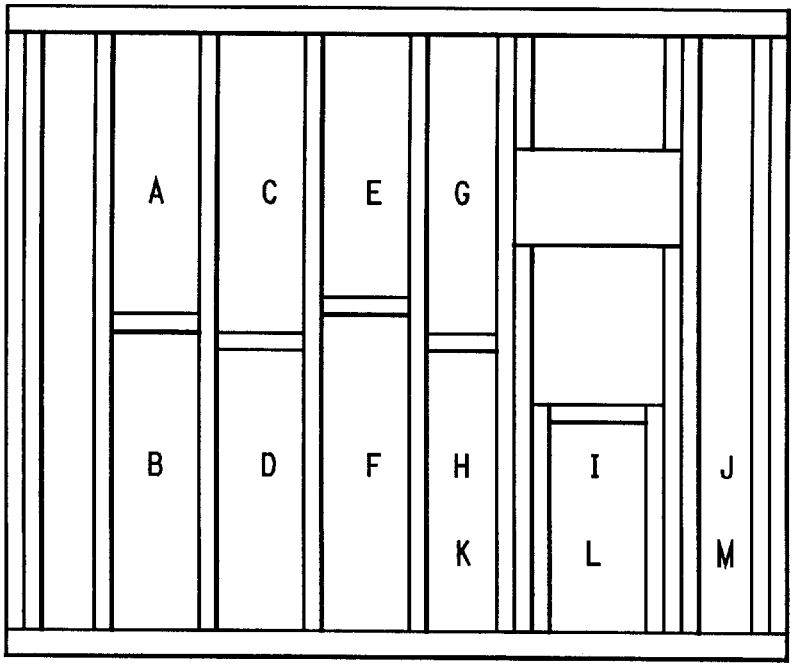
FIG. 8 is a front view of a wall section frame to which a barrier sheet material can be attached.
Figure 9:
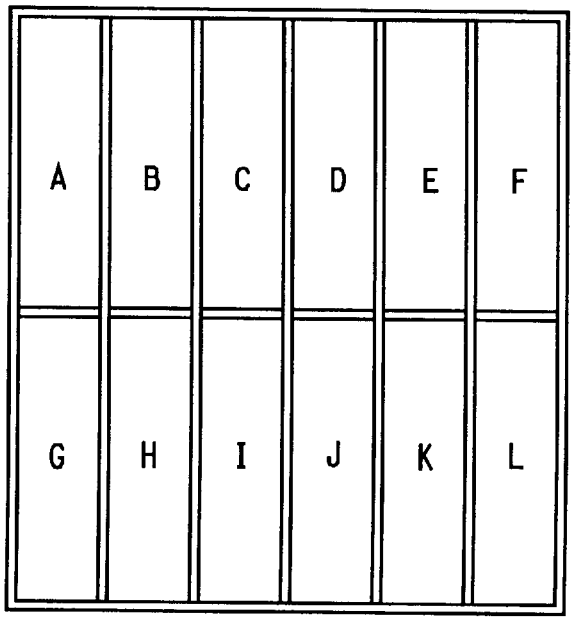
FIG. 9 is a front view of another wall section frame to which a barrier sheet material can be attached.

The textured barrier sheet of the invention can also be incorporated into hybrid systems or Exterior Insulation and Finish Systems ("EIFS"), as shown in FIG. 7. In an EIFS construction, the barrier sheet 40 is used as the moisture barrier between the structure and a foam board 80. While the barrier sheet 40 is shown as a grooved sheet, any of the other embodiments of the barrier sheet of the invention, such as the corrugated or random polyhedral patterns described above, can be used in place of the grooved sheet. A fiberglass mesh 81 is attached to the outside of the foam board 80. A base coat 82 is applied over the fiberglass mesh and a finish coat 84 is applied over the base coat 82. In a hybrid system the fiberglass mesh 81 is replaced with metal lath. The barrier sheet provides a means of escape for water and water vapor trapped between the foam board and the rest of the structure. When the barrier sheet of the invention is used in an EIFS stucco construction, it is not necessary to cut channels in the foam boards or insert a drainage mat between the foam board and the barrier sheet, as discussed in the background section above.

Another beneficial property of the barrier sheet material of the invention is that the material is more durable than a flat barrier sheet material with similar strength properties. When a barrier sheet material is applied directly to the studs of a structure's frame, the barrier sheet material is easily ripped off the structure by wind until the outer layers of the structure's exterior walls are completed. It has been found that a textured barrier sheet can withstand a higher wind load without being torn off the studs than is possible with a flat sheet of the same material that has not been textured. It is believed that the textured barrier sheet material can withstand these greater wind loads because the textured structure makes the sheet more flexible and resilient than a flat sheet.

The following non-limiting examples are intended to illustrate the invention and not to limit the invention in any manner.

EXAMPLES

In the description above and in the non-limiting examples that follow, the following test methods were employed to determine various reported characteristics and properties. ASTM refers to the American Society for Testing and Materials, TAPPI refers to the Technical Association of Pulp and Paper Industry, AATCC refers to the American Association of Textile Chemists and Colorists, and ISO refers to the International Organization for Standardization.

Basis Weight was determined by ASTM D-3776, which is hereby incorporated by reference, and is reported in $g/m^2$.

Sheet Thickness was determined by ASTM method D 1777-64, which is hereby incorporated by reference, and is reported in microns.

Tensile Strength was determined by ASTM D 1682, Section 19, which is hereby incorporated by reference, with the following modifications. In the test, a 2.54 cm by 20.32 cm (1 inch by 8 inch) sample was clamped at opposite ends of the sample. The clamps were attached 12.7 cm (5 in) from each other on the sample. The sample was pulled steadily at a speed of 5.08 cm/min (2 in/min) until the sample broke. The force at break was recorded in Newtons/2.54 cm as the breaking tensile strength. The area under the stress-strain curve was the work to break.

Elongation of a sheet is a measure of the amount a sheet stretches prior to failure (breaking) in a strip tensile test. A 1.0 inch (2.54 cm) wide sample is mounted in the clamps—set 5.0 inches (12.7 cm) apart—of a constant rate of extension tensile testing machine such as an Instron table model tester. A continuously increasing load is applied to the sample at a crosshead speed of 2.0 in/min (5.08 cm/min) until failure. The measurement is given in percentage of stretch prior to failure. The test generally follows ASTM D1682-64.

Elmendorf Tear Strength is a measure of the force required to propagate a tear cut in a sheet. The average force required to continue a tongue-type tear in a sheet is determined by measuring the work done in tearing it through a fixed distance. The tester consists of a sector-shaped pendulum carrying a clamp that is in alignment with a fixed clamp when the pendulum is in the raised starting position, with maximum potential energy. The specimen is fastened in the clamps and the tear is started by a slit cut in the specimen between the clamps. The pendulum is released and the specimen is torn as the moving clamp moves away from the fixed clamp. Elmendorf tear strength is measured in Newtons in accordance with the following standard methods: TAPPI-T-414 om-88 and ASTM D 1424, which are hereby incorporated by reference. The tear strength values reported for the examples below are each an average of at least twelve measurements made on the sheet.

Hydrostatic Head is a measure of the resistance of the sheet to penetration by liquid water under a static load. A 7×7 in (17.78×17.78 cm) sample is mounted in a SDL 18 Shirley Hydrostatic Head Tester (manufactured by Shirley Developments Limited, Stockport, England). Water is pumped against one side of a 102.6 $cm^2$ section of the sample at a rate of 60+/−3 cm/min until three areas of the sample are penetrated by the water. The measured hydrostatic pressure is measured in inches, converted to SI units and given in centimeters of water. The test generally follows AATCC-127 or IOS811.

Moisture Vapor Transmission Rate (MVTR) is determined by ASTM E398-83 (which has since been withdrawn), which is hereby incorporated by reference. MVTR is reported in $g/m^2/24$ hr. MVTR data acquired by ASTM E398-83 was collected using a Lyssy MVTR tester model L80-4000J and is identified herein as "LYSSY" data. Lyssy is based in Zurich, Switzerland. MVTR test results are highly dependent on the test method used and material type. Important variables between test methods include the water vapor pressure gradient, volume of air space between liquid and sheet sample, temperature, air flow speed over the sample and test procedure. ASTM E398-83 (the "LYSSY" method) is based on a vapor pressure "gradient" of 85% relative humidity ("wet space") vs. 15% relative humidity ("dry space"). The LYSSY method measures the moisture diffusion rate for just a few minutes and under a constant humidity delta, which measured value is then extrapolated over a 24 hour period. The LYSSY method provides a higher MVTR value than ASTM E96, Method B for a moisture permeable fabric like the barrier sheet material of the invention.

Gurley Hill Porosity is a measure of the air permeability of the sheet material for gaseous materials. In particular, it is a measure of how long it takes for a volume of gas to pass through an area of material wherein a certain pressure gradient exists. Gurley-Hill porosity is measured in accordance with TAPPI T-460 om-88 using a Lorentzen & Wettre Model 121D Densometer. This test measures the time required for 100 cubic centimeters of air to be pushed through a one inch diameter sample under a pressure of approximately 125 mm of water. The result is expressed in seconds and is usually referred to as Gurley Seconds.

Length Loss is measured by measuring the length of a printed pattern in a direction perpendicular to sheet folds on a sheet and comparing the measured length against the length of the pattern prior to texturing. The percent length loss is equal to (the original length—the textured length)/(the original length).

Cement Slump is measured according to ASTM C143-90a (Slump Measurement of Hydraulic Cement Concrete) modified for stucco by using a 6 inch high cone instead of a 12 inch high cone. Slump is expressed in inches.

Sand Quality is measured according to ASTM 144 and is reported as a Sand Equivalent ("SE").

Examples 1–7A

In Examples 1–7A, grooved barrier sheet material was prepared by means of the creping process shown in FIG. 4 and described above. Spunbonded sheets of flashspun polyethylene plexifilamentary film-fibrils, as disclosed in U.S. Pat. No. 3,169,899, were bonded on a thermal calender bonder as disclosed in PCT Publication No. WO 97/40224 to obtain flat bonded sheets with one of the following sets of properties:

| Sheet Type | A | B | C | D | E | F* |
|---|---|---|---|---|---|---|
| Basis Weight (g/m$^2$) | 61 | 61 | 61 | 61 | 61 | 61 |
| Thickness microns | 137 | 140 | 165 | 145 | 163 | 127 |
| MVTR-LYSSY | 695 | 653 | 475 | 215 | 900 | 600 |
| Hydrostatic Head (cm) | 239 | 218 | 229 | 305 | 203 | 305 |
| Gurley Hill Porosity (sec) | 1360 | 943 | 826 | >3000 | 220 | 1600 |
| Tensile Strength-MD (N/cm) | 56 | 56 | 49 | 54 | 40 | 50 |
| Tensile Strength-CD (N/cm) | 67 | 63 | 51 | 60 | 49 | 53 |
| Elongation-MD (%) | 14 | 12 | 9 | 11 | 8 | 11 |
| Elongation-CD (%) | 16 | 16 | 12 | 15 | 13 | 14 |
| Elmendorfl Tear-MD (N) | 7.6 | 8.9 | 11.6 | 10.7 | 10.5 | 7.1 |

-continued

| Sheet Type | A | B | C | D | E | F* |
|---|---|---|---|---|---|---|
| Elmendorf Tear-CD (N) | 6.7 | 8.5 | 9.3 | 8.5 | 9.4 | 7.5 |

*Data represents average properties of sheet produced over several months.

The flat sheets described above were creped as described in U.S. Pat. No. 4,090,385 according the creping conditions listed in Table 1 below. The "roll surface" of the crepe roll is either flat or grooved. A flat crepe roll is used with a flat creping blade while a "grooved" roll surface is used with a "comb" creping blade. The blade setting specifies the dimensions of the primary surface and the spacing of the retarder blade from the crepe roll surface. In setting 1, the primary surface was 0.030 mils thick and the retarder blade was 0.005 mils thick. In setting 2, the primary surface was 0.020 mils thick and the retarder blade was 0.005 mils thick. In addition, in setting 2, a 0.005 mils thick secondary retarder blade was spaced 0.010 mils above the primary retarder blade. In setting 3, the primary surface was 0.030 mils thick and the retarder blade was 0.005 mils thick. In addition, in setting 3, a 0.005 mils thick secondary retarder blade was spaced 0.010 mils above the primary retarder blade.

The creped barrier sheets had the physical properties listed in Table 1 below.

TABLE 1

| EXAMPLE | 1 | 2 | 3 | 4 |
|---|---|---|---|---|
| Sheet Type | A | A | A | A |
| Creping Process Conditions | | | | |
| Roll Surface | Flat | Grooved | Grooved | Flat |
| Blade | Flat | Grooved | Combed | Flat |
| Roll Temperature (° C.) | 68 | 71 | 68 | 68 |
| Blade Setting | 3 | 3 | 3 | 3 |
| Product Properties | | | | |
| Basis Weight (g/m$^2$) | 68 | 68 | 68 | 73 |
| Amplitude of Grooves (microns) | 737 | 940 | 406 | 1143 |
| Length Loss (%) | 28 | 16 | 13 | 19 |
| MVTR-LYSSY (g/m$^2$/24 hr) | 747 | 1163 | 924 | — |
| Hydrostatic Head (cm) | 223 | 201 | 231 | 247 |
| Gurley Hill Porosity (sec) | 250 | 458 | 330 | 207 |
| Tensile Strength-MD (N/cm) | 42 | 35 | 40 | 47 |
| Tensile Strength-CD (N/cm) | 70 | 54 | 51 | 58 |
| Elongation-MD (%) | 13 | 13 | 11 | 14 |
| Elongation-CD (%) | 17 | 14 | 15 | 18 |
| Elmendorf Tear-MD (N) | 10.7 | 11.6 | 7.6 | 7.1 |
| Elmendorf Tear-CD (N) | 12.9 | 12.0 | 11.6 | 10.7 |
| EXAMPLE | 5 | 6 | 7 | 7A* |
| Sheet Type | A | A | D | F |
| Creping Process Conditions | | | | |
| Roll Surface | Flat | Flat | Flat | Flat |
| Blade | Flat | Flat | Flat | Flat |
| Roll Temperature (° C.) | 90 | 68 | 25 | 68 |
| Blade Setting | 3 | 3 | 1 | 3 |
| Product Properties | | | | |
| Basis Weight (g/m$^2$) | 73 | 71 | 68 | 75 |
| Amplitude of Grooves (microns) | 1092 | 457 | 675 | 1066 |
| Length Loss (%) | 13 | 14 | 21 | 15 |
| MVTR-LYSSY (g/m$^2$/24 hr) | 1331 | 1012 | 847 | 1250 |
| Hydrostatic Head (cm) | 208 | 231 | 305 | 185 |
| Gurley Hill Porosity (sec) | 73 | 200 | 979 | 300 |
| Tensile Strength-MD (N/cm) | 44 | 51 | 49 | 49 |
| Tensile Strength-CD (N/cm) | 66 | 58 | 66 | 50 |

TABLE 1-continued

| | | | | |
|---|---|---|---|---|
| Elongation-MD (%) | 13 | 13 | 16 | 13.5 |
| Elongation-CD (%) | 18 | 17 | 20 | 14 |
| Elmendorf Tear-MD (N) | — | 8.5 | — | 9.3 |
| Elmendorf Tear-CD (N) | — | 10.7 | — | 9.8 |

*Data represents average properties of sheet produced over several months.

Examples 8 and 9

Figure 18:
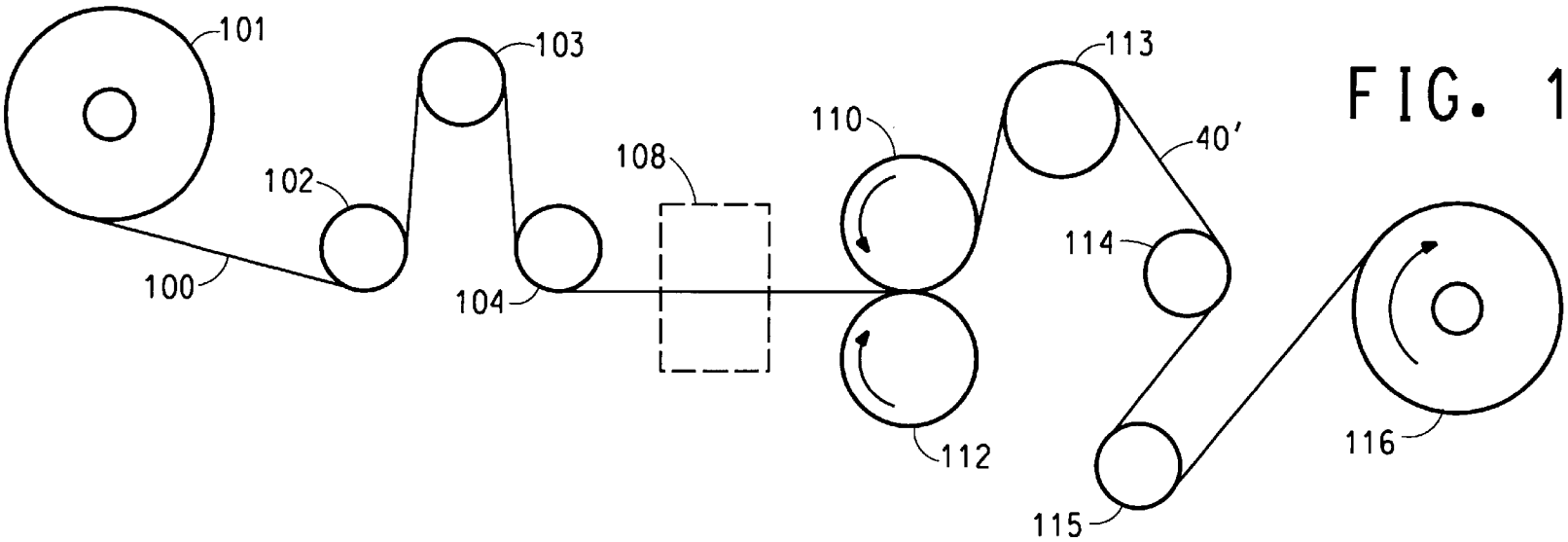
FIG. 18 is a schematic representation of a process for producing the barrier sheet material of the invention.

In Examples 8 and 9, textured barrier sheet material as shown in FIGS. 11–15 was prepared by means of the matched metal embossing process shown in FIG. 18 and described above. Spunbonded sheets of flashspun polyethylene plexifilamentary film-fibrils, as disclosed in U.S. Pat. No. 3,169,899, were bonded on a thermal calender bonder as disclosed in PCT Publication No. WO 97/40224 to obtain flat bonded sheets with the following sets of properties:

| Sheet Type | G | H |
|---|---|---|
| Basis Weight (g/m$^2$) | 61.0 | 61.0 |
| Thickness (microns) | 124.5 | 88.9 |
| MVTR-LYSSY | 997 | 631 |
| Hydrostatic Head (cm) | 244.9 | 296.2 |
| Gurley Hill Porosity (sec) | 233.1 | 856.6 |
| Tensile Strength-MD (N/cm) | 56.0 | 55.3 |
| Tensile Strength-CD (N/cm) | 46.6 | 48.9 |
| Elongation-MD (%) | 9.7 | 8.8 |
| Elongation-CD (%) | 13.9 | 11.5 |
| Elmendorfl Tear-MD (N) | 6.6 | 7.7 |
| Elmendorf Tear-CD (N) | 7.1 | 8.1 |

The flat sheets described above were embossed according to the process described above with reference to FIG. 18. The physical properties of the resulting embossed barrier sheets are also listed in Table 2 below.

TABLE 2

| EXAMPLE | 8 | 9 |
|---|---|---|
| Sheet Type | G | H |
| Line Speed (feet per minute) | 100 | 100 |
| Product Properties | | |
| Basis Weight (g/m$^2$) | 69.8 | 67.1 |
| Avg. Textured Sheet Thickness (microns) | 713.7 | 696.0 |
| Max. Drainage Channel Depth (microns) | 589.2 | 607.1 |
| MVTR-LYSSY (g/m$^2$/24 hr) | 948 | 1431 |
| Hydrostatic Head (cm) | 211.1 | 274.6 |
| Gurley Hill Porosity (sec) | 420.8 | 259.6 |
| Tensile Strength-MD (N/cm) | 73.0 | 81.1 |
| Tensile Strength-CD (N/cm) | 61.6 | 69.2 |
| Elongation-MD (%) | 17.1 | 18.9 |
| Elongation-CD (%) | 22.9 | 24.9 |
| Elmendorf Tear-MD (N) | 4.0 | 2.5 |
| Elmendorf Tear-CD (N) | 6.0 | 5.0 |

Example 10

Figure 10:
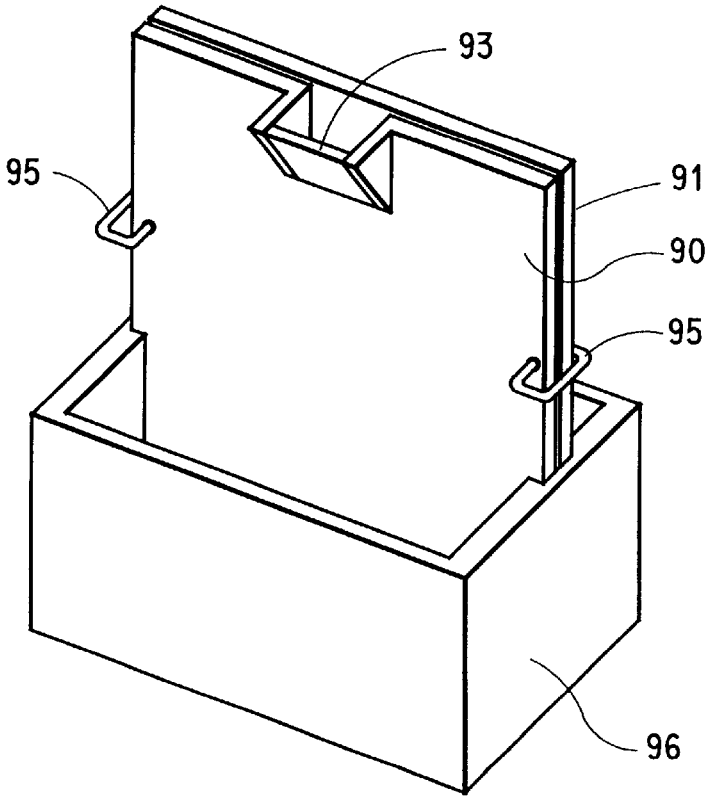
FIG. 10 is a perspective view of a drainage testing unit used for testing the drainage properties of barrier sheet materials.

Nine different barrier sheets were tested in a drainage testing unit in order to evaluate the relative drainage performance of the sheet materials. The drainage testing unit is shown in FIG. 10. The testing unit included two plexiglass panels that were 9.875 inches (25.1 cm) tall, 8.1875 inches (20.8 cm) wide, and 0.35 inches (0.89 cm) thick. The front panel 90 had a trough opening 93 that was 1.8 inches (4.6 cm) wide centered at the top edge of the front panel 90. Sheets of barrier material were inserted between the panels 90 and 91 in a manner such that the top edge of the sample aligned with the top edge of panel 91 and the vertical midline of the sample was centered in the trough opening 93. Four clamps 95 held the panels together with a force of about 50 pounds (222 N). The two top clamps were positioned 0.3125 inches (0.79 cm) in from the edges of the panels and 0.875 inches (2.2 cm) down from the top of the panels. The two bottom clamps were positioned 0.3125 inches (0.79 cm) in from the edges of the panels and 5 inches (12.7 cm) down from the top of the panels. The clamped plexiglas panels 90 and 91 fit in a collection base 96 that holds the plexiglas panels about 2.5 inches (6.4 cm) above the bottom of the collection base so as to permit liquid between the panels to drain out of the panels.

The nine barrier sheet materials listed below were tested one at a time in the drainage testing unit described in the paragraph above according to the following procedure ("the Barrier Sheet Drainage Test Method"). For each test, a barrier sheet material sample was clamped in the drainage testing unit as described above. Twenty milliliters of water was poured into the trough opening such that water was passed between the panel 90 and the barrier sheet material. The water drained out the bottom of the panels and was collected in the collection base. The time needed to pass a given amount of water through the assembly was measured. The timer was started as the water was first poured into the trough opining. The timer was stopped when the top surface of the water reached the bottom off the panels. If 15 minutes elapsed before all the water drained out, the amount of water collected was measured and a flow rate was calculated. The results are reported in Table 3 below in units of milliliters per hour per inch width of sheet material.

Barrier Sheet A—An 8 inch by 10 inch (20.3 cm×25.4 cm) sample of a Grade D asphalt saturated kraft paper with a basis weight of 9.0 oz/yd$^2$ (305 g/m2) and a 60 minute rating, manufactured by Leatherback Industries of Hollister, Calif.

Barrier Sheet B—An 8 inch by 10 inch (20.3 cm×25.4 cm) sample of a flat spunbonded polyethylene plexifilamentary sheet material more fully described in Example 1 as Type E (sold as TYVEK® Homewrap®).

Barrier Sheet C—A 2 inch by 10 inch (5.1 cm×25.4 cm) sample of a spunbonded polyethylene plexifilamentary sheet more fully described in Example 1 as Type E (sold as TYVEK® Homewrap®) that had been embossed with a diamond pattern. The embossing was done at a speed of 2.5 cm/sec using a 10 cm wide embossing roll having a diameter of 8 cm that was heated to 65° C., and was pressed against an 8 cm hard paper backup roll. Each diamond in the embossed pattern was about 7.9 mm high and about 3.2 mm wide. The embossed lines that formed the borders of adjoining diamonds were about 0.15 mm deep and about 1.6 mm wide.

Barrier Sheet D—A 2 inch by 10 inch (5.1 cm×25.4 cm) sample of a spunbonded polyethylene plexifilamentary sheet more fully described in Example 1 as Type E (sold as TYVEK® Homewrap®) that had been embossed with a button pattern. The embossing was done a speed of 2.5 cm/sec using a 5.1 cm wide embossing roll having a diameter of 4 cm that was heated to 65° C., and was pressed against an 8 cm hard paper backup roll. The buttons were about 3.2 mm in diameter and 0.21 mm high. The buttons of the embossed pattern were spaced on 6.4 mm centers in the horizontal direction. The rows were offset by 3.2 mm.

Barrier Sheet E—An 8 inch by 10 inch sample (20.3 cm×25.4 cm) of a spunbonded polyethylene plexifilamentary sheet more fully described in Example 1 as Type E (sold as TYVEK® Homewrap®) to which polyethylene, 10 pound, 18 mil (44.5 N, 0.46 mm) fishing line was applied in a vertical direction on one side thereof. The strings of fishing line were spaced every half inch.

Barrier Sheet F—An 8 inch by 10 inch (20.3 cm×25.4 cm) sample of a spunbonded polyethylene plexifilamentary sheet more fully described in Example 1 as Type E (sold as TYVEK® Homewrap®) with a scrim material applied to the side of the sheet against which water was poured during the test. The scrim material was a polyethylene netting sold under the name VEXAR® H10 by DuPont of Canada of Whitby, Onatario, Canada. The scrim was made of polyethylene strands that were interconnected in a manner to form a diamond-shaped pattern in which the diamonds had a width of about 32 mm wide and a length of about 50 mm. The polyethylene strands were about 25 mils thick at the nodes where the strands connected to each other. The other portions of the strands were about 6 mils thick. The scrim material was applied to one side of the sheet material with the long axis of the diamonds oriented vertically. When this barrier sheet was put in the drainage tester, the scrim side of the barrier sheet was placed against the front panel 90 of the tester with the long lengthwise axis of the diamonds was oriented in the vertical direction.

Figure 5:
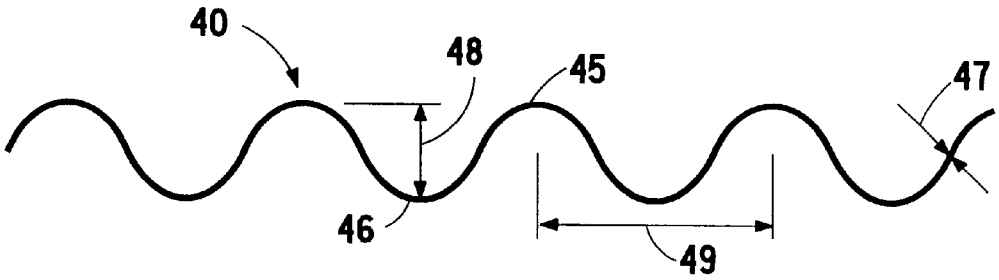
FIG. 5 is an end view of a barrier sheet material made according to the invention.

Barrier Sheet G—An 8 inch by 10 inch sample (20.3 cm×25.4 cm) of a spunbonded polyethylene plexifilamentary sheet more fully described in Example 1 as Type F flat sheet material that had been subjected to microstretching as described in U.S. Pat. No. 4,223,059. In the microstretching process, the spunbonded sheet was passed between two geared rolls. The flat sheet was passed between passed two geared rolls that each had a length of 36 cm and a diameter of 20 cm. Each of the geared rolls was covered with 2.3 mm high teeth that extended the length of the roll and there were 16 teeth per inch (6.3 teeth per cm) on the surface of the rolls. The two geared rolls were aligned such that the end of the tooth of one roll extended 1.4 mm into the groove of the other roll. The sheet was fed between the rolls at a speed of about 15 meters per minute (50 feet/min). The basis weight of the microstretched sheet was increased from about 61 $g/m^2$ to about 63 $g/m^2$ by the microstretching process. The sheet material maintains its thickness 47 (FIG. 5) at about 127 microns (5 mils). The amplitude 48 of the waves in the waves (FIG. 5) in the sheet were about 508 mm (20 mils) and the wave length 49 of the waves in the sheet were about 2.1 mm. The channels between wave peaks form substantially continuous and contiguous channels that run the full width (cross direction) of the sheet material on each side of the sheet material.

Barrier Sheet H—An 8 inch by 10 inch (20.3 cm×25.4 cm) sample of the creped spunbonded polyethylene plexifilamentary sheet material of Example 7A.

TABLE 3

| Barrier Sheet | Description | Drainage Rate (ml/hour/inch material) |
|---|---|---|
| A | Asphalt saturated Kraft Paper | 0.6 |
| B | TYVEK ® - Flat | 42 |
| C | TYVEK ® - Embossed diamond pattern | 451 |
| D | TYVEK ® - Embossed button pattern | 469 |
| E | TYVEK ® - Laminated with fishing line | 4,235 |
| F | TYVEK ® - Laminated with scrim | 33,103 |

TABLE 3-continued

| Barrier Sheet | Description | Drainage Rate (ml/hour/inch material) |
|---|---|---|
| G | TYVEK ® - Microstreched | 800 |
| H | TYVEK ® - Creped | 8,107 |

(1 ml/hr/inch = .39 ml/hr/cm)

Example 11

The samples of textured barrier sheet material described previously in Examples 8 and 9, with a pattern like that shown in FIGS. 11–15, were tested in a drainage testing unit in order to evaluate the drainage performance. The drainage testing unit used was like the testing unit shown in FIG. 10 and explained in Example 10 with the one exception that through opening 93 centered at the top edge of the front panel 90 was 5.3125 inches (13.49 cm) wide.

The two textured barrier sheet materials listed below were tested one at a time in the drainage testing unit according to the following procedure. For each test, a textured barrier sheet material sample was clamped in the drainage testing unit as described in Example 10. Fifty milliliters of water was poured into the trough opening such that water passed between the panel 90 and the textured barrier sheet material. The water drained out the bottom of the panels and was collected in the collection base 96. The time required for all of the water to drain out of the trough opening 93 was measured. The timer was started as the water was first poured into the trough opening. The timer was stopped when the top surface of the water reached the bottom of the trough opening. Then, a flow rate was calculated by dividing the volume of water poured into the trough (50 milliliters) by the amount of time required for all of the water to evacuate the trough, and then dividing the result by the width of the trough opening (5.3125 inches). The results are reported in Table 4 below in units of milliliters per hour per inch width of textured sheet material.

Barrier Sheet A—An 8 inch by 10 inch (20.3 cm×25.4 cm) sample of the embossed spunbonded polyethylene plexifilamentary sheet material of Example 8.

Barrier Sheet B—An 8 inch by 10 inch (20.3 cm×25.4 cm) sample of the embossed spunbonded polyethylene plexifilamentary sheet material of Example 9.

TABLE 4

| Barrier Sheet | Description | Drainage Rate (ml/hour/inch material) |
|---|---|---|
| A | TYVEK ® - Embossed random polyhedral pattern | 3080.2 |
| B | TYVEK ® - Embossed random polyhedral pattern | 2420.2 |

(1 ml/hr/inch = .39 ml/hr/cm)

Example 12

A test was conducted to compare the ability of following three barrier sheet materials to act as a break against capillary transfer of water through a wall system. A control wood sample without any barrier sheet was also tested.

Barrier Sheet A—A Grade D asphalt saturated kraft paper with a basis weight of 9.0 $oz/yd^2$ (305 $g/m^2$) and a 60 minute rating, manufactured by Fortifiber Inc. of Los Angeles, Calif.

Barrier Sheet B—A flat spunbonded polyethylene plexifilamentary sheet material more fully described in Example 1 as Type E (sold as TYVEK® Homewrap®).

Barrier Sheet C—The creped spunbonded polyethylene plexifilamentary sheet material of Example 7A.

Four ⅞ inch (2.2 cm) thick pieces of white pine wood were cut in the shape of a 4 inch by 4 inch (10.2 cm×10.2 cm) squares. The moisture level in the wood square was measured using a Lignomat K100 moisture meter made by Lignomat of Portland, Oreg. The moisture meter had two moisture sensing pins that were driven 12 mm into one side of each wood square. The moisture sensing pins were spaced 4 inches (10.2 cm) from each other on the diagonal of the wood square. The moisture meter was able to measure moisture content in the wood until the moisture level reach about 25%. The side of the wood square with the moisture sensing pins was then covered with a 6 mil (0.15 mm) thick vapor impermeable polyethylene film. Each of the three barrier sheet materials was placed over the side of one of the wood squares opposite the side into which the moisture pins had been driven .

The wood squares used in the tests had initial moisture contents of from 8% to 10%. In the three tests in which the sample was covered with a barrier sheet material, the side of the wood square covered with the barrier sheet was set on top of a sponge that was larger than the wood square and was saturated with water for at least two weeks. The exposed surface of the fourth wood square was also placed on a water saturated sponge. The moisture level in each wood sample was measured on a regular basis over the next two weeks. The average rate of moisture gain during the first week that the wood square was on the saturated sponged and the maximum moisture level reached during the two week period is reported in Table 5 below.

TABLE 5

| | Barrier Sheet Type | Initial Moisture Content in Wood (%) | Wood Moisture Content after 7 Days (%) | Max Rate of Moisture Gain over any 4 day period (%/hr) | Max Moisture Content During First 14 Days (%) |
|---|---|---|---|---|---|
| A | Asphalt Saturated Paper | 8.1 | 15.2 | 0.052 | 17.8 |
| B | Flat Spunbonded - Type E | 8.4 | 13.1 | 0.052 | 14.7 |
| C | Creped Spunbonded - from Ex. 7A | 9.9 | 12.8 | 0.017 | 13.5 |
| | No Barrier Sheet Material | 9.9 | 27.9 | .201 | 30 |

It will be apparent to those skilled in the art that modifications and variations can be made in breathable composite sheet material of this invention. The invention in its broader aspects is, therefore, not limited to the specific details or the illustrative examples described above. Thus, it is intended that all matter contained in the foregoing description, drawings and examples shall be interpreted as illustrative and not in a limiting sense.

What is claimed is:

1. A construction membrane comprising a unitary, nonwoven, spunbonded, barrier sheet material consisting essentially of synthetic plexifilamentary fibers, said sheet material having a basis weight of less than 600 g/m$^2$, a hydrostatic head of greater than 12 cm, a Gurley Hill porosity of greater than 10 seconds, a moisture vapor transmission rate, measured by the LYSSY method, of at least 25 g/m$^2$/day, said barrier sheet material having a first side thereof, said first side thereof being textured with protrusions in a random polyhedral pattern, said protrusions having a height in the range of 0.25 mm to 1.0 mm, said protrusions defining channels oriented in multiple directions for providing paths by which a liquid against the first side of the sheet can drain.

2. The construction membrane of claim 1, wherein said barrier sheet material has a basis weight of less than 300 g/m2, a hydrostatic head of greater than 50 cm, a Gurley Hill porosity of greater than 60 seconds, and a moisture vapor transmission rate, measured by the LYSSY method, of at least 100 g/m$^2$/day.

3. The construction membrane of claim 2 wherein said barrier sheet material has a basis weight of less than 125 g/m$^2$, a hydrostatic head of greater than 150 cm, a Gurley Hill porosity of greater than 120 seconds, and a moisture vapor transmission rate, measured by the LYSSY method, of at least 250 g/m$^2$/day.

4. The construction membrane of claim 1 wherein said synthetic fibers consist essentially of polyolefin polymer fibers.

5. The construction membrane of claim 4 wherein said polyolefin polymer fibers consist essentially of polyethylene.

6. The construction membrane of claim 1 wherein said multiple protrusions are formed in said barrier sheet material by an embossing process.

7. The construction membrane of claim 1 wherein said barrier sheet has a drainage rate, measured according to the Barrier Sheet Drainage Test Method, of at least 150 ml/hr/inch.

8. The construction membrane of claim 7 wherein said barrier sheet has a drainage rate, measured according to the Barrier Sheet Drainage Test Method, of at least 1000 ml/hr/inch.

9. The construction membrane of claim 8 wherein said barrier sheet has a drainage rate, measured according to the Barrier Sheet Drainage Test Method, of at least 2000 ml/hr/inch.

10. A wall structure comprising a support frame, a barrier sheet material over said support frame, and an exterior protective layer over said barrier sheet, wherein said barrier sheet material is a unitary, nonwoven, spunbonded sheet consisting essentially of synthetic plexifilamentary fibers, said sheet material having a basis weight of less than 600 g/m$^2$, a hydrostatic head of greater than 12 cm, a Gurley Hill porosity of greater than 10 seconds, a moisture vapor transmission rate, measured by the LYSSY method, of at least 25 g/m$^2$/day, and wherein said barrier sheet material has a first side thereof, said first side thereof being textured with protrusions in a random polyhedral pattern, said protrusions having a height in the range of 0.25 mm to 1.0 mm, said protrusions defining channels oriented in multiple directions for providing a path by which a liquid against the first side of the sheet can drain.

11. The wall structure of claim 10 wherein said exterior protective layer is selected from the group of stucco, hybrid stucco, brick, stone, wood siding, metal siding, and synthetic siding materials.

12. The wall structure of claim 11 wherein said synthetic fibers consist essentially of polyolefin polymer fibers.

13. The wall structure of claim 12 wherein the polyolefin polymer fibers consist essentially of polyethylene.

* * * * *